US008160469B2

(12) United States Patent
Tokuda

(10) Patent No.: US 8,160,469 B2
(45) Date of Patent: Apr. 17, 2012

(54) INFORMATION PROCESSING APPARATUS, METHOD FOR CONTROLLING THE INFORMATION PROCESSING APPARATUS, AND STORAGE MEDIUM

(75) Inventor: Akihiko Tokuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 12/581,809

(22) Filed: Oct. 19, 2009

(65) Prior Publication Data

US 2010/0098449 A1 Apr. 22, 2010

(30) Foreign Application Priority Data

Oct. 20, 2008 (JP) ..... 2008-269563

(51) Int. Cl.
*G03G 15/00* (2006.01)

(52) U.S. Cl. ..... 399/81; 399/182; 399/407; 399/408

(58) Field of Classification Search ..... 399/75, 399/81, 182–185, 407–410; 715/243–247
See application file for complete search history.

(56) References Cited

U.S. PATENT DOCUMENTS 6,896,426 B2 5/2005 Nakagiri
6,952,542 B1 10/2005 Morikawa
7,245,845 B2 * 7/2007 Isobe et al. ..... 399/82
7,634,725 B2 * 12/2009 Nishikawa ..... 715/243
2003/0052441 A1 3/2003 Nakagiri
2004/0111675 A1 6/2004 Mori

FOREIGN PATENT DOCUMENTS

JP 11-194667 A 7/1999
JP 2003-091380 A 3/2003
JP 2004-192248 A 7/2004
JP 2004-192248 A 7/2004
JP 2005-115683 A 4/2005
JP 2008-193669 A 8/2008

* cited by examiner

*Primary Examiner* — Hoan Tran
(74) *Attorney, Agent, or Firm* — Canon U.S.A., Inc. IP Division

(57) ABSTRACT

An apparatus includes a setting unit configured to set binding processing for binding a part of the document data including data of plurality of pages as a partial binding set for the document data, and a display control unit configured to display a setting verification image for verifying a status of setting of the binding processing by using a binding mark, which indicates that the binding processing is set, on a display apparatus in a display state in which the plurality of partial binding sets is discriminable.

30 Claims, 32 Drawing Sheets

FIG.4

| NO | ATTRIBUTE INFORMATION | | DESCRIPTIONS |
|---|---|---|---|
| 1 | PRINT METHOD | ONE-SIDED/TWO-SIDED/ BOOKBINDING PRINTING | |
| 2 | PAPER SIZE | ORIGINAL SIZE/ FIXED SIZE | · Z-FOLDING WHEN "A4 + A3", "B4 + B3", OR "LETTER + LEDGER (11 * 17) HAS BEEN DESIGNATED<br>· SIZE OF FIRST CHAPTER OR FIRST PAGE OF DOCUMENT IS AUTOMATICALLY SELECTED IF BOOKBINDING PRINTING OR N-up PRINTING HAS BEEN DESIGNATED |
| 3 | PAPER ORIENTATION | PORTRAIT/ LANDSCAPE | · PAPER ORIENTATION CAN BE DESIGNATED ONLY WHEN FIXED SIZE HAS BEEN DESIGNATED |
| 4 | BINDING MARGIN/ BINDING DIRECTION | | · SHIFT/SCALING CAN BE DESIGNATED |
| 5 | DESIGNATION OF N-up PRINTING | NUMBER OF PAGES/ IMPOSITION/ BORDERLINE/ IMPOSITION PATTERN | · 9 PATTERNS ARE AVAILABLE FOR IMPOSITION<br>· DIRECT PRINTING CAN BE DESIGNATED |
| 6 | ENLARGEMENT AND REDUCTION | ON/OFF | · DESIGNATION OF ENLARGEMENT AND REDUCTION CAN BE AUTOMATICALLY SET "ON" OR "OFF" IF FIXED SIZE HAS BEEN DESIGNATED FOR PAPER SIZE OR N-up PRINTING HAS BEEN DESIGNATED |
| 7 | WATERMARK | | · WATERMARK CAN BE SEPARATELY AND INDIVIDUALLY DESIGNATED FOR EACH LOGICAL OR PHYSICAL PAGE<br>· WATERMARK CAN BE DESIGNATED FOR ALL CHAPTERS OR PAGES |
| 8 | HEADER AND FOOTER | | · HEADER AND FOOTER CAN BE SEPARATELY AND INDIVIDUALLY DESIGNATED FOR EACH LOGICAL OR PHYSICAL PAGE<br>· HEADER AND FOOTER CAN BE DESIGNATED FOR ALL CHAPTERS OR PAGES |
| 9 | SHEET DISCHARGE METHOD | STAPLING/PUNCHING | · STAPLING/PUNCHING CAN BE SET FOR ONLY ONE-SIDED PRINTING OR TWO-SIDED PRINTING<br>· STAPLING CAN BE SET AT ONE POSITION OR TWO POSITIONS |
| 10 | DETAILED DESIGNATION OF BINDING | DESIGNATIONS ON DIRECTION OF OPENING, SADDLE STITCH BINDING, DESIGNATION OF SCALING, BINDING MARGIN, AND VOLUME CLASSIFICATION | · ONLY AVAILABLE FOR BOOKBINDING PRINT |
| 11 | FRONT COVER AND BACK COVER | | · PRINTING DESIGNATION OF FRONT OR BACK COVER CAN BE SET FOR FRONT COVER 1 OR 2 OR BACK COVER 1 OR 2<br>· SHEET FEEDING PORT (INCLUDING INSERTER) CAN BE DESIGNATED |
| 12 | INDEX SHEET | | · PRINTING OF CHARACTER STRING ON INDEX SHEET AND ANNOTATION ON INDEX SHEET CAN BE SET<br>· IF BOOKBINDING PRINTING HAS BEEN DESIGNATED, INDEX SHEET CANNOT BE DESIGNATED |
| 13 | INSERTED SHEET | | · SHEET FEEDING PORT (INCLUDING INSERTER) CAN BE DESIGNATED<br>· ORIGINAL DATA CAN BE PRINTED ON INSERTED SHEET<br>· IF BOOKBINDING PRINTING HAS BEEN DESIGNATED, INSERTED SHEET CANNOT BE DESIGNATED |
| 14 | CHAPTER BREAK | "NO" / "PAGE-BY-PAGE BREAK" / "SHEET-BY-SHEET BREAK" | · IF INDEX SHEET OR INSERTED SHEET HAS BEEN DESIGNATED, THEN ONLY "SHEET-BY-SHEET BREAK" CAN BE SET<br>· IF ONE-SIDED PRINTING HAS BEEN DESIGNATED, THEN ONLY "SHEET-BY-SHEET BREAK" CAN BE SET |

FIG.5

| NO | ATTRIBUTE INFORMATION | | DESCRIPTIONS |
|---|---|---|---|
| 1 | PAPER SIZE | ORIGINAL SIZE/ FIXED SIZE | · IF FIXED SIZE HAS BEEN SELECTED, "PAGE-BY-PAGE BREAK" IS AUTOMATICALLY DESIGNATED<br>· IF A PLURALITY OF TYPES OF SHEETS HAS BEEN SELECTED FOR BOOK, SHEET SIZE CAN BE CHANGED ONLY FOR DESIGNATED SHEET. EVEN IF IT HAS BEEN DESIGNATED TO SET THE PAPER SIZE ACCORDING TO THE SIZE OF BOOK, PAPER SIZE CAN BE CHANGED |
| 2 | PAPER ORIENTATION | PORTRAIT/ LANDSCAPE | · PAPER ORIENTATION CAN BE DESIGNATED ONLY WHEN FIXED SIZE HAS BEEN DESIGNATED |
| 3 | DESIGNATION OF N-up PRINTING | NUMBER OF PAGES/ IMPOSITION/ BORDERLINE/ IMPOSITION PATTERN | · 9 PATTERNS ARE AVAILABLE FOR IMPOSITION<br>· DIRECT PRINTING CAN BE DESIGNATED |
| 4 | ENLARGEMENT AND REDUCTION | ON/OFF | · DESIGNATION OF ENLARGEMENT AND REDUCTION CAN BE AUTOMATICALLY SET "ON" OR "OFF" IF FIXED SIZE HAS BEEN DESIGNATED FOR PAPER SIZE OR N-up PRINTING HAS BEEN DESIGNATED |
| 5 | WATERMARK | DISPLAY/ NON-DISPLAY | · DESIGNATION ON WHETHER TO DISPLAY ALL WATERMARKS DESIGNATED IN BOOK |
| 6 | HEADER AND FOOTER | DISPLAY/ NON-DISPLAY | · DESIGNATION ON WHETHER TO DISPLAY ALL HEADERS AND FOOTERS DESIGNATED IN BOOK |
| 7 | SHEET DISCHARGE METHOD | STAPLING | · DESIGNATED SHEET DISCHARGE METHOD CAN BE SET "OFF" IF STAPLING HAS BEEN DESIGNATED IN BOOK"<br>· DESIGNATION OF SHEET DISCHARGE METHOD IS SET "ON" AS DEFAULT |

FIG.6

| NO | ATTRIBUTE INFORMATION | | DESCRIPTIONS |
|---|---|---|---|
| 1 | DESIGNATION ON ROTATION OF PAGE | | · 0°, 90°, 180°, OR 270° CAN BE DESIGNATED |
| 2 | WATERMARK | DISPLAY/ NON-DISPLAY | · DESIGNATION ON WHETHER TO DISPLAY ALL WATERMARKS DESIGNATED IN BOOK |
| 3 | HEADER AND FOOTER | DISPLAY/ NON-DISPLAY | · DESIGNATION ON WHETHER TO DISPLAY ALL HEADERS AND FOOTERS DESIGNATED IN BOOK |
| 4 | ZOOMING | IN THE RANGE OF 50% - 200% | · ZOOMING CAN BE DESIGNATED AT A RELATIVE RATIO TO 100% SIZE FITTING VIRTUAL LOGICAL PAGE AREA |
| 5 | IMPOSITION PATTERN | | · 9 PATTERNS ARE PRESET AND ARBITRARY PATTERNS CAN BE DESIGNATED |
| 6 | ANNOTATION | | |
| 7 | Variable ITEM | | |
| 8 | DIVISION OF PAGE | | |

FIG.14

EXAMPLE OF SUBSET STAPLING page1
~
page30
} NOT TO BE STAPLED (QUESTION SHEET: FOR 30 EXAMINEES)

page31
page32
page33
page34
page35
} TO BE STAPLED (ANSWER SHEET: FOR FIRST EXAMINEE)

....

page171
page172
page173
page174
page175
} TO BE STAPLED (ANSWER SHEET: FOR 29TH EXAMINEE)

page176
page177
page178
page179
page180
} TO BE STAPLED (ANSWER SHEET: FOR 30TH EXAMINEE)

page181
page182
page183
page184
} NOT TO BE STAPLED (EXPLANATORY MATERIAL: FOR 4 PERSONS OF EXPLAINING STAFF)

FIG.18

1801

| PAGE NUMBER | STAPLE POSITION | STAPLING SHAPE |
|---|---|---|
| 1 | NONE | NONE |
| 2 | NONE | NONE |
| ~ | | |
| 30 | NONE | NONE |
| 31 | UPPER-LEFT | FIRST |
| 32 | UPPER-LEFT | MIDDLE |
| 33 | UPPER-LEFT | MIDDLE |
| 34 | UPPER-LEFT | MIDDLE |
| 35 | UPPER-LEFT | LAST |
| ~ | | |
| 176 | UPPER-LEFT | FIRST |
| 177 | UPPER-LEFT | MIDDLE |
| 178 | UPPER-LEFT | MIDDLE |
| 179 | UPPER-LEFT | MIDDLE |
| 180 | UPPER-LEFT | LAST |
| 181 | NONE | NONE |
| 182 | NONE | NONE |
| 183 | NONE | NONE |
| 184 | NONE | NONE |

INFORMATION PROCESSING APPARATUS, METHOD FOR CONTROLLING THE INFORMATION PROCESSING APPARATUS, AND STORAGE MEDIUM

BACKGROUND OF THE INVENTION

1. Field of the Invention

The present invention relates to an information processing apparatus and a method for controlling the information processing apparatus.

2. Description of the Related Art

A printing apparatus has been marketed, such as a printer or a copying machine, which is capable of executing binding processing such as stapling processing on document data being edited on an information processing apparatus such as a personal computer (PC), and which is capable of instructing printing of a plurality of copies of a printed sheet bundle.

In addition, a document processing system has been marketed, which is capable of not only designating whether to execute stapling processing on the entire print job but also designating a range of chapters or pages to be stapled of a printing target document. In the above-described system, a user can issue a designation of a partial stapling instruction for instructing whether to execute stapling on each chapter, of a plurality of portions (chapters or pages) of document data.

Japanese Patent Application Laid-Open No. 2003-91380 discusses a system including a printing processing apparatus that generates print data according to a partial stapling instruction designated by a user and executes stapling according to the print data. Japanese Patent Application Laid-Open No. 2003-91380 further discusses a method for designating partial stapling processing and a method for causing a printing processing apparatus to execute partial stapling.

Furthermore, Japanese Patent Application Laid-Open No. 11-194667 discusses a method for improving the visibility when setting a hierarchical structure. Japanese Patent Application Laid-Open No. 2004-192248 discusses a method, in a document processing system that processes a document having a hierarchical structure including a plurality of chapters, for improving the operability of the system by simply applying a setting for a chapter set before division thereof as an attribute of a chapter newly generated by division.

In the above-described conventional method, a binding mark (e.g., a staple mark), which indicates that binding processing has been designated by the user, is displayed on a preview screen for previewing document data designated to be stapled as binding processing. However, the above-described conventional method executes the same display for each partial binding set (partial staple set in this case) to which partial stapling processing has been designated. Accordingly, the user may not know a staple start position (page) and a staple end position (page).

Furthermore, if the designation of partial stapling is displayed by a tree view, the above-described conventional method displays the designation of stapling processing for each chapter with an icon. Therefore, the user may not know whether mutually adjacent chapters belong to the same partial stapling set or different partial stapling sets.

SUMMARY OF THE INVENTION

According to an aspect of the present invention, an apparatus includes a setting unit configured to set binding processing for binding a part of the document data including data of a plurality of pages as a partial binding set for the document data, and a display control unit configured to display a setting verification image for verifying a status of setting of the binding processing by using a binding mark, which indicates that the binding processing is set, on a display apparatus in a display state in which the plurality of partial binding sets is discriminable.

According to an exemplary embodiment of the present invention, a partial binding set, which is set via a display such as a preview display or a tree view display, can be displayed in a display state with which a user can easily recognize the displayed content.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

FIG. 4 illustrates an example of a list of book attributes according to an exemplary embodiment of the present invention.

FIG. 5 illustrates an example of a list of chapter attributes according to an exemplary embodiment of the present invention.

FIG. 6 illustrates an example of a list of page attributes according to an exemplary embodiment of the present invention.

FIG. 14 illustrates an example of a partial stapling set according to an exemplary embodiment of the present invention.

FIG. 18 illustrates an example of an each-page stapling state table according to an exemplary embodiment of the present invention.

DESCRIPTION OF THE EMBODIMENTS

Various exemplary embodiments, features, and aspects of the invention will be described in detail below with reference to the drawings.

Now, an example of a document processing system according to a first exemplary embodiment of the present invention will be described in detail below with reference to FIGS. 1 through 13. In the document processing system, a data file generated by a general application is converted into an electronic original file by an electronic original writer. A bookbinding application provides a function for editing the electronic original file.

In the present exemplary embodiment, functions of each of the general application, the electronic original writer, the bookbinding application, and an electronic original despooler are separately provided for clearly describing various functions implemented in the document processing system. However, a package to be provided to a user is not limited to this configuration. The functions implemented in the document processing system can be provided as an application or a graphic engine including a combination thereof.

Figure 1:
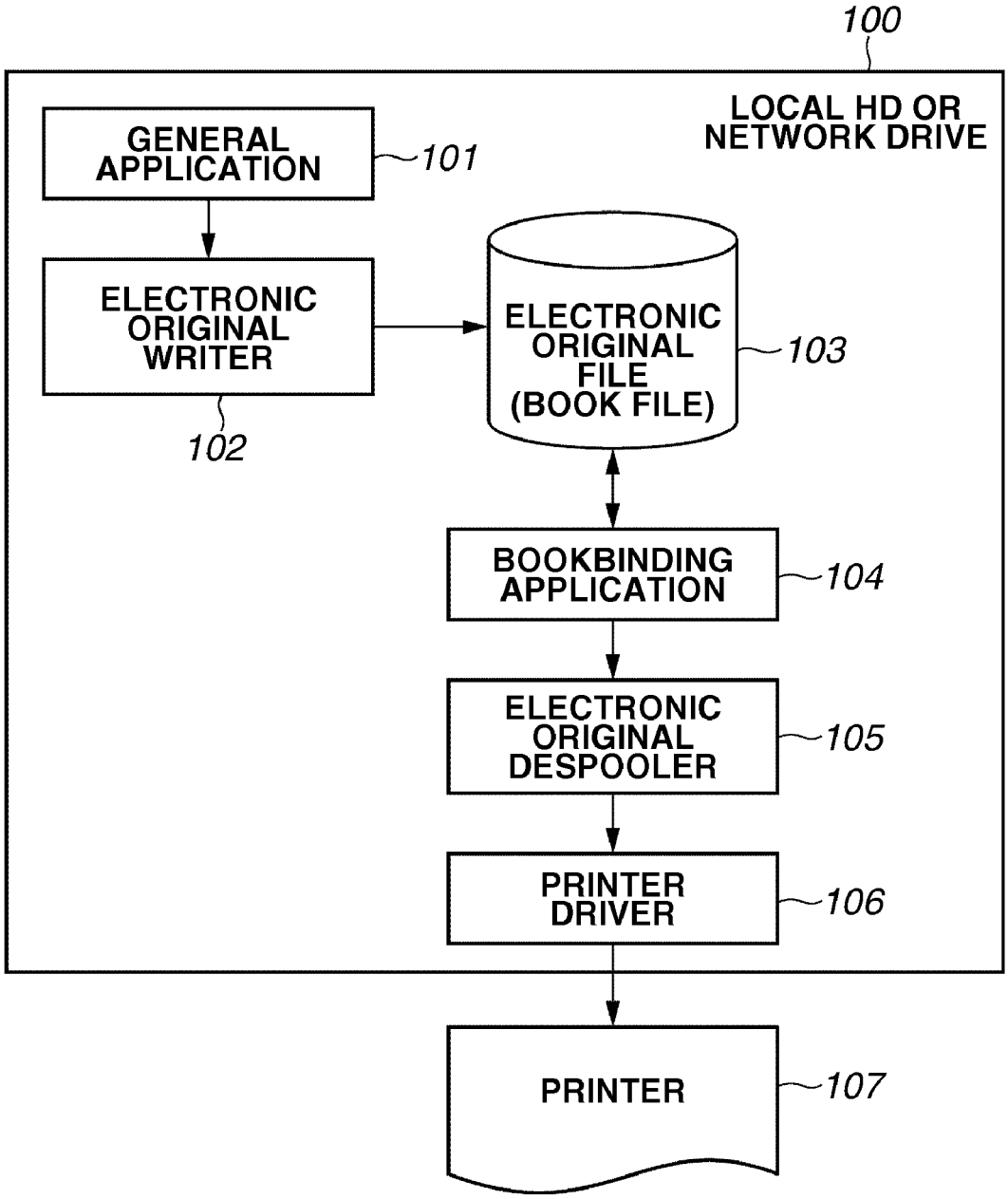
FIG. 1 is a block diagram illustrating an exemplary software configuration of a stand-alone type document processing system according to an exemplary embodiment of the present invention.

FIG. 1 illustrates an exemplary software configuration of the document processing system according to the present exemplary embodiment. The document processing system is implemented by a host computer 100, which is an exemplary embodiment of an information processing apparatus of the present invention.

A general application 101 is an application program that provides various functions, such as a word processing function, a spreadsheet function, a photo retouch function, a draw or paint function, a presentation function, and a text editing function. The general application 101 has a printing function for an operating system (OS).

In printing application data, such as generated document data or image data, the general application 101 utilizes a predetermined interface (a graphic device interface (GDI)) which is provided by the OS.

More specifically, an arbitrary general application 101 transmits an output command (a "GDI function") of a predetermined format dependent on the OS to an output module of the OS that provides a predetermined interface to print the generated data. After receiving the output command, the output module converts the output command into a format that an output device, such as a printer, can process. Then, the output module outputs the converted command (a device driver interface (DDI) function).

The format that the output device can process may be different according to a type, manufacturer, and a model of the device. Accordingly, a unique device driver for controlling the device is provided to each device. The OS uses the device driver to convert the command, generates print data, and describes it in a job language (JL) to generate a print job. When Windows® of Microsoft Corporation is used as the OS (operating system), a module called GDI corresponds to the output module described above.

An electronic original writer 102 is an improvement of the above-described device driver. The electronic original writer 102 is a software module provided to realize the present document processing system. However, the electronic original writer 102 does not target a specific output device but instead converts the output command into a command of a format that can be processed by a bookbinding application 104 and a printer driver 106. The bookbinding application 104 and the printer driver 106 will be described in detail below.

The format after the conversion (hereinafter referred to as an "electronic original format") by the electronic original writer 102 may be any format only if each original page can be expressed in a detailed form. Among substantial standard formats, the portable document format (PDF) format of Adobe Systems, Inc. and the scalable vector graphics (SVG) format provided by World Wide Web Consortium (W3C), for example, can be employed as the electronic original format.

When the electronic original writer 102 is utilized by the general applications 101, the electronic original writer 102 is designated as a device driver to be used for output before executing printing. However, an electronic original file just generated by the electronic original writer 102 does not have a complete format as an electronic original file.

Therefore, the bookbinding application 104 designates the electronic original writer 102 as a device driver. Application data is converted into an electronic original file under control of the bookbinding application 104. The bookbinding application 104 completes a new and incomplete electronic original file generated by the electronic original writer 102 as an electronic original file having a format to be described later.

Hereinbelow, a file generated by the electronic original writer 102 is referred to as an "electronic original file" and an electronic original file that has been given a structure by the bookbinding application 104 is referred to as a "book file". Otherwise, a document file generated by an application, an electronic original file, and a book file, the file is collectively referred to as a "document file" (or "document data").

As described above, the electronic original writer 102 is designated as the device driver and the general application 101 prints the application data. Thus, the application data is converted into an electronic original format. The application data of the electronic original format is stored on a storage medium such as a hard disk as a converted electronic original file (i.e., book file) 103. The application data is converted into an electronic original format in the unit of a page defined by the general application 101 (hereinafter referred to as a "logical page" or an "original page").

As the hard disk, a local drive included in the host computer 100 that implements the document processing system according to the present exemplary embodiment can be used. Alternatively, if communication via a network is available, a drive provided on the network can be used as the hard disk.

The bookbinding application 104 provides the user with a function for reading the electronic original file (book file) 103 and editing the read book file 103. However, the bookbinding application 104 does not include a function for editing the content of each page but provides a function for editing the structure of a chapter and a book, which include a page as their minimum unit. A "chapter" and a "book" will be described in detail below.

In printing the book file 103 that has been edited by the bookbinding application 104, the bookbinding application 104 activates an electronic original despooler 105. The electronic original despooler 105 is a program module installed in a computer together with the bookbinding application 104. Further, the electronic original despooler 105 is a module used for outputting drawing data to the printer driver 106 and a printer 107 when a document (book file) utilized by the bookbinding application 104 is printed.

The electronic original despooler 105 reads a designated book file 103 from the hard disk. Further, the electronic original despooler 105 generates an output command compliant with the output module of the OS to print each page in the format described in the read book file 103 and outputs the generated output command to the output module. In outputting the output command to the output module, the printer driver 106 of the printer 107 which is used as an output device is designated as a device driver.

The output module converts the output command received by using the designated printer driver 106 of the printer 107 into a device command that the printer 107 can interpret and execute. Then, the device command is transmitted to the printer 107. The printer 107 prints an image according to the received device command on a print sheet.

Figure 2:
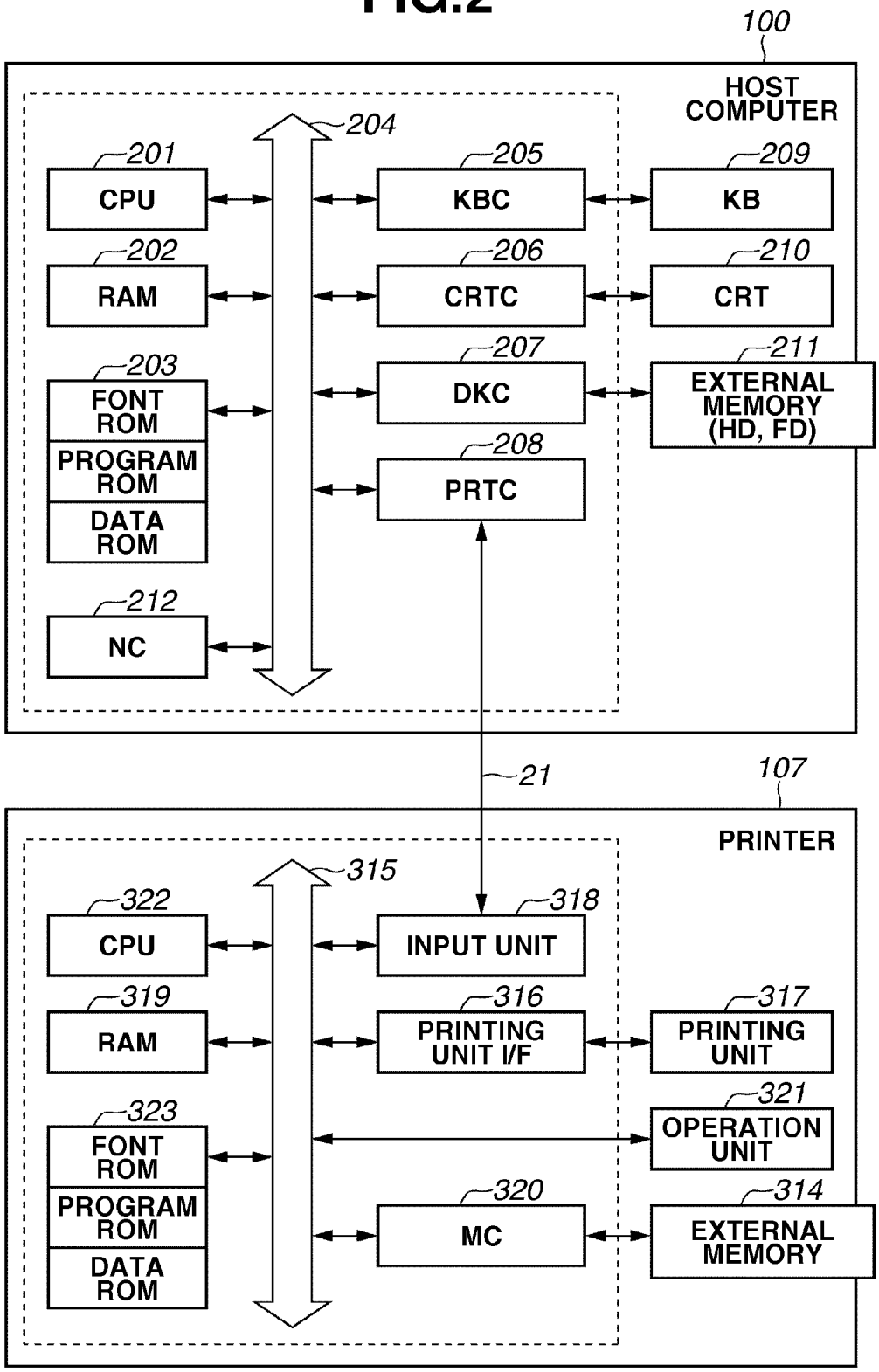
FIG. 2 illustrates an exemplary hardware configuration that can implement the document processing system according to an exemplary embodiment of the present invention.

FIG. 2 illustrates an exemplary hardware configuration of the document processing system according to the present exemplary embodiment.

Referring to FIG. 2, the host computer 100 includes a central processing unit (CPU) 201. The CPU 201 executes processing according to a program, such as a document processing program stored on a program read-only memory (ROM) of a ROM. 203 (e.g., font ROM, program ROM, data ROM) or an external memory (i.e., HD, FD) 211. The processing executed by the CPU 201 includes processing of a document which mixedly includes components, such as a diagram, an image, a character, or a table (including a spreadsheet). Further, the CPU 201 controls an entire operation of devices connected to a system bus 204 of the host computer 100.

The program ROM of the ROM 203 or the external memory 211 stores a program, such as an OS, which is a control program for the CPU 201. A font ROM of the ROM 203 or the external memory 211 stores data, such as font data which is used in processing a document. A data ROM of the ROM 203 or the external memory 211 stores various data used in executing various processing, such as the document processing.

A random access memory (RAM) 202 functions as a main memory and a work area of the CPU 201. A keyboard controller (KBC) 205 controls a key input from a keyboard (KB) 209 and a command input from a pointing device (not illustrated). A cathode ray tube (CRT) controller (CRTC) 206 controls display on a CRT display (CRT) 210.

A disk controller (DKC) 207 controls access to/from the external memory 211 such as a hard disk (HD) and a floppy disk (FD). The external memory 211 stores various programs and data, such as a boot program, various applications, font data, a user file, a file to be edited, and a printer driver.

A printer controller (PRTC) 208 is connected to the printer 107 via a predetermined interactive interface 21 and controls a communication with the printer 107. A network controller (NC) 212 is connected to a network and controls communication between the host computer 100 and other apparatuses on the network.

The CPU 201 rasterizes an outline font on a display information RAM which is provided on the RAM 202 to provide a graphic user interface (GUI). Thus, "what you see is what you get" (WYSIWIG) on the CRT 210 is implemented. In addition, the CPU 201 opens various registered windows according to a command issued by a user by using a mouse cursor (not illustrated) on the CRT 210 to execute various types of data processing.

In executing printing, the user opens a window (operation screen) for performing a print setting and can execute settings of the printer 107 and a printing method for the printer driver including selection of a print mode. The printer 107 includes a central processing unit (CPU) 322, which controls the operation of the printer 107.

In addition, the printer CPU 322 outputs an image signal (output information) to a (printer engine) 317 according to a control program stored on a ROM (including font ROM, program ROM, and data ROM) 323 or an external memory 314. The printing unit 317 is connected to a system bus 315 via a printing unit I/F 316.

A program ROM of the ROM 323 stores a program, such as a control program for the CPU 322. A font ROM of the ROM 323 stores the data such as font data for generating the above-described output information. When a printer that does not include an external memory 314 such as an HD is used, a data ROM of the ROM 323 stores information utilized by the host computer 100.

The printer CPU 322 can communicate with the host computer 100 via an input unit 318. The printer CPU 322 can notify various pieces of information about the printer 107 to the host computer 100.

A random access memory (RAM) 319 functions as a main memory and a work area of the printer CPU 322. A memory capacity of the RAM 319 can be expanded with an optional RAM, which can be connected to an expansion port (not illustrated). The RAM 319 is used as an output information rasterization area, an environmental data storage area, and a non-volatile random access memory (NVRAM).

Access to/from the external memory 314, which is an HD or an integrated circuit (IC) card, is controlled by a memory controller (MC) 320. The external memory 314, which is connected as an optional memory, stores the font data, an emulation program, form data, or the like.

An operation panel (i.e., operation unit) 321 includes components, such as operation switches which implement various operations on the printer 107 and a light-emitting diode (LED) indicator.

The number of the external memories 314 is not limited to one. More specifically, a plurality of external memories 314 may be provided and a plurality of optional font cards, in addition to the built-in font, and a plurality of external memories storing a program for interpreting a printer control language (PCL) of different language systems can be connected. In addition, an NVRAM (not illustrated) may be provided to store printer mode setting information from the operation unit 321.

Before describing the details of the bookbinding application 104, a data format of a book file is described at first.

A book file has a 3-layer structure as a book made of paper sheets. More specifically, a top layer "book" corresponds to one book, and includes a definition of an attribute of the entire document. An intermediate layer "chapter" corresponds to a chapter of a paper book. Each "chapter" includes a definition of an attribute of each thereof. A bottom layer "page" corresponds to each page defined by the application program. Each page can include an attribute of each page.

One book can include a plurality of chapters, while one chapter can include a plurality of pages.

Figure 3:
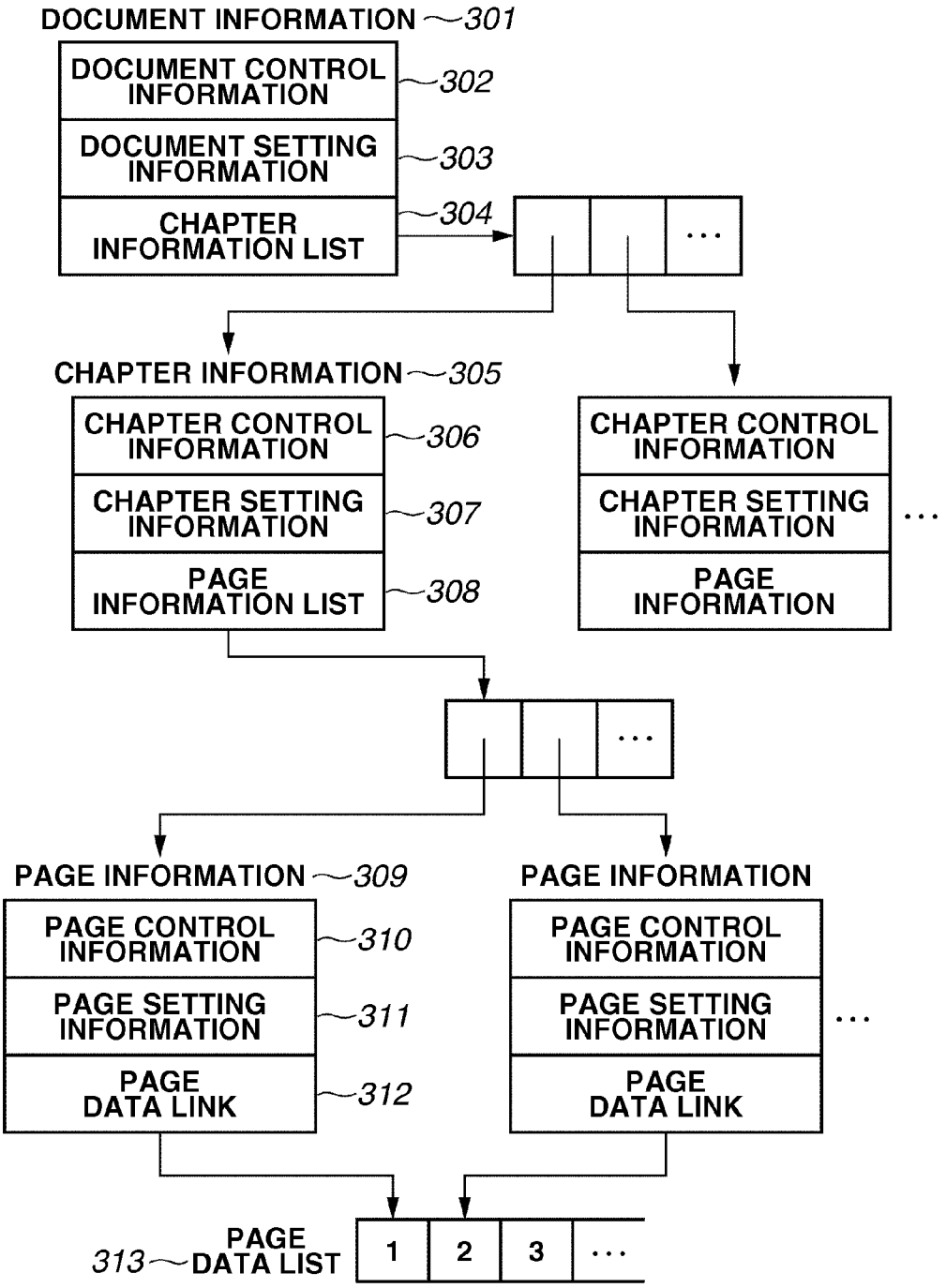
FIG. 3 illustrates an exemplary structure of a book file according to an exemplary embodiment of the present invention.

FIG. 3 illustrates an exemplary data format of a book file according to the present exemplary embodiment. Each of a book, chapter, and page of the book file illustrated in FIG. 3 is indicated with a node corresponding thereto. One book file includes one book. A book and a chapter are concepts that define the structure of the book. Accordingly, a book and a chapter include a defined attribute value and a link to a lower layer as an entity thereof.

A page includes data of each page output by the application program as its entity. Accordingly, a page includes its attribute value, the entity of a page of an original (hereinafter referred to as an "original page data") and a link to each original page data.

A printed page to be output on a print sheet such as a paper medium may include a plurality of original pages. This structure is not indicated by the link but indicated as an attribute of each layer of book, chapter, and page.

In the example illustrated in FIG. 3, a "book" is described as a "document" in general because it is not necessary that a book file is one integrated book.

Referring to FIG. 3, a document includes document information 301 on its top layer. The document information 301 includes three broad portions 302 through 304. Document control information 302 stores information such as a path name in a file system of a document file. Document setting information 303 stores layout information such as a page layout and setting information about a function of the printing apparatus such as a stapling function. The document setting information 303 corresponds to an attribute of a book.

A chapter information list 304 stores an aggregate of chapters constituting a document as a list. The list stores chapter information 305. The chapter information 305 includes three broad portions 306 through 308.

Chapter control information 306 stores information about a name of a chapter. Chapter setting information 307 stores information about a page layout and stapling which are set uniquely to the chapter. The chapter setting information 307 corresponds to an attribute of a chapter.

As described above, each chapter includes the chapter setting information 307. Accordingly, a document having an intricate layout whose first chapter has a 2-up layout while whose other chapters have a 4-up layout, for example, can be generated.

A page information list 308 stores an aggregate of original pages constituting each chapter as a list. The page information list 308 includes page information data 309. The page information data 309 includes three broad portions 310 through 312.

Page control information 310 stores information such as a page number indicated with a tree structure. Page setting information 311 stores information such as page rotational angle and page layout information. The page setting information 311 corresponds to an attribute of an original page.

Page data link information 312 is original data corresponding to a page. In the example illustrated in FIG. 3, the page information data 309 does not directly include the original data but include the page data link information 312 only. The actual original data is stored in the page data list 313.

FIG. 4 illustrates an example of a book attribute (the document setting information 303) according to the present exemplary embodiment.

In general, an item that can be defined in duplication with a lower layer, an attribute value of the lower layer is prioritized over its upper layer. Accordingly, an item that is included only in a book attribute, a value defined in the book attribute becomes valid for the entire book.

On the other hand, the item that can be defined in duplication with a lower layer can be used as a default value of a case where no definition is provided in the lower layer. In the present exemplary embodiment, it can be selected whether to prioritize the attribute value of the lower layer.

In the example illustrated in FIG. 4, each item does not necessarily correspond to only one setting item. That is, an item can include a plurality of related setting items.

Referring to FIG. 4, the following six items can be included in a book attribute as unique items, namely, "printing method", "bookbinding details", "front cover/back cover", "index sheet", "inserted sheet", and "chapter break". The items can be defined in a book.

For the attribute "printing method", a value of three setting items, namely, "one-sided printing", "two-sided printing", and "bookbinding printing", can be designated.

"Bookbinding printing" is a method for printing in which a printed sheet bundle including a separately designated number of sheets is two-folded and bound into a book, for example. With respect to the attribute "bookbinding details", if bookbinding is designated as a layout method, then an item such as the direction of opening, the number of sheets of a bundle, and the like, can be designated.

The attribute "front cover/back cover" includes designation of using a front/back cover sheet and the content to be printed on the cover sheet if printing an electronic original file to be bound into a book.

The attribute "index sheet" includes designation of inserting a tabbed index sheet as a chapter break, which is separately set on the printing apparatus, and designation of the content to be printed on the index portion (tab). The attribute "index sheet" becomes enabled if an inserter having a function for inserting a sheet provided separately from the printing sheet at a desired position of a sheet bundle is provided to the printing apparatus or if a plurality of sheet feed cassettes can be used. The same applies to the attribute "inserted sheet".

The attribute "inserted sheet" includes designation of inserting a sheet supplied from the inserter or the sheet feed cassette as a chapter break. Further, if it is designated to insert such a sheet, the attribute "inserted sheet" can include designation of a sheet feed source.

The attribute "chapter break" can designate, for a chapter break, whether to use a new sheet, whether to use a new page to be printed, or whether not to apply a particular operation for the chapter break. In the case of one-sided printing, the chapter break is set in the same format regardless of whether a new sheet or a new page to be printed is designated. On the other hand, in two-sided printing, if it is designated to use a new sheet for a chapter break, different two consecutive chapters are not printed on a same sheet while if it is designated to use a new page to be printed for a chapter break, different two consecutive chapters may be printed on the front side and the back side of one sheet, respectively.

FIG. 5 illustrates an example of a chapter attribute (the chapter setting information 307) according to the present exemplary embodiment. FIG. 6 illustrates an example of a page attribute (the page setting information 311) according to the present exemplary embodiment. The relationship between the chapter attribute and the page attribute is similar to the relationship between the book attribute and an attribute of a lower layer.

In the chapter attribute, no item unique to a chapter is defined and all items are the same as those defined in the book attribute. Accordingly, if the definition in the chapter attribute differs from the definition in the book attribute, then the parameter value defined in the chapter attribute is generally prioritized and used. However, in the present exemplary embodiment, it can be selected whether to prioritize the attribute value defined in the lower layer.

Only five items, such as the paper size, the paper orientation, designation of N-up printing, enlargement/reduction, and a sheet discharge method, are defined in common to the book attribute and the chapter attribute. Among the five common items, the attribute "N-up printing" designates the number of original pages to be printed on one page. For the type of the N-up layout, "1×1", "1×2", "2×2", "3×3", or "4×4", for example, can be designated.

The attribute "sheet discharge method" designates whether to execute stapling on the discharged sheet. The attribute "sheet discharge method" becomes enabled if the printing apparatus to be used includes the stapling function.

The attributes such as "page rotation", "zooming", "imposition", "annotation", "page division", or the like can be defined uniquely to the page attribute. The attribute "page rotation" designates the rotational angle of a page when an original page is imposed on a page to be printed. The attribute "zooming" designates a zooming (enlargement) ratio of the original page. The zooming ratio is a ratio of the size of the original page to the size of a virtual logical page area (100%).

A virtual logical page area refers to an area of one original page when the original page is imposed according to the layout designation such as N-up printing. For example, if the imposition "1×1" is designated, the virtual logical page area corresponds to the area of one printing page. On the other hand, if the imposition "1×2" is designated, the virtual logical page area corresponds to the area of one printing page whose each side is reduced to 70% of its original size.

The attributes "watermark" and "header/footer" are defined in common to the book, the chapter, and the page attributes. A "watermark" refers to information such as an image or a character string, which is designated separately from image data generated by an application and is printed in superimposition therewith.

Each of a header and footer is a watermark printed in a top margin or a bottom margin of each page. An item that can be designated by a variable, namely, information such as a page number or date and time, is provided to the header and the footer.

The contents that can be designated in the watermark attribute and the header/footer attribute are the same in the chapter attribute and the page attribute, but are different in the book attribute.

In the book attribute, the content of the watermark and the header and footer can be designated. In addition, in the book attribute, a method for printing the watermark and the header and footer can be designated in the entire book. On the other hand, in the chapter attribute and the page attribute, it can be designated whether to print the watermark or the header and footer set in the book attribute in the corresponding chapter or page.

Exemplary processing for generating a book file executed by the bookbinding application 104 and the electronic original writer 102 will be described in detail below. The book file generation processing is implemented as a part of an operation of the bookbinding application 104 for editing a book file.

Figure 7:
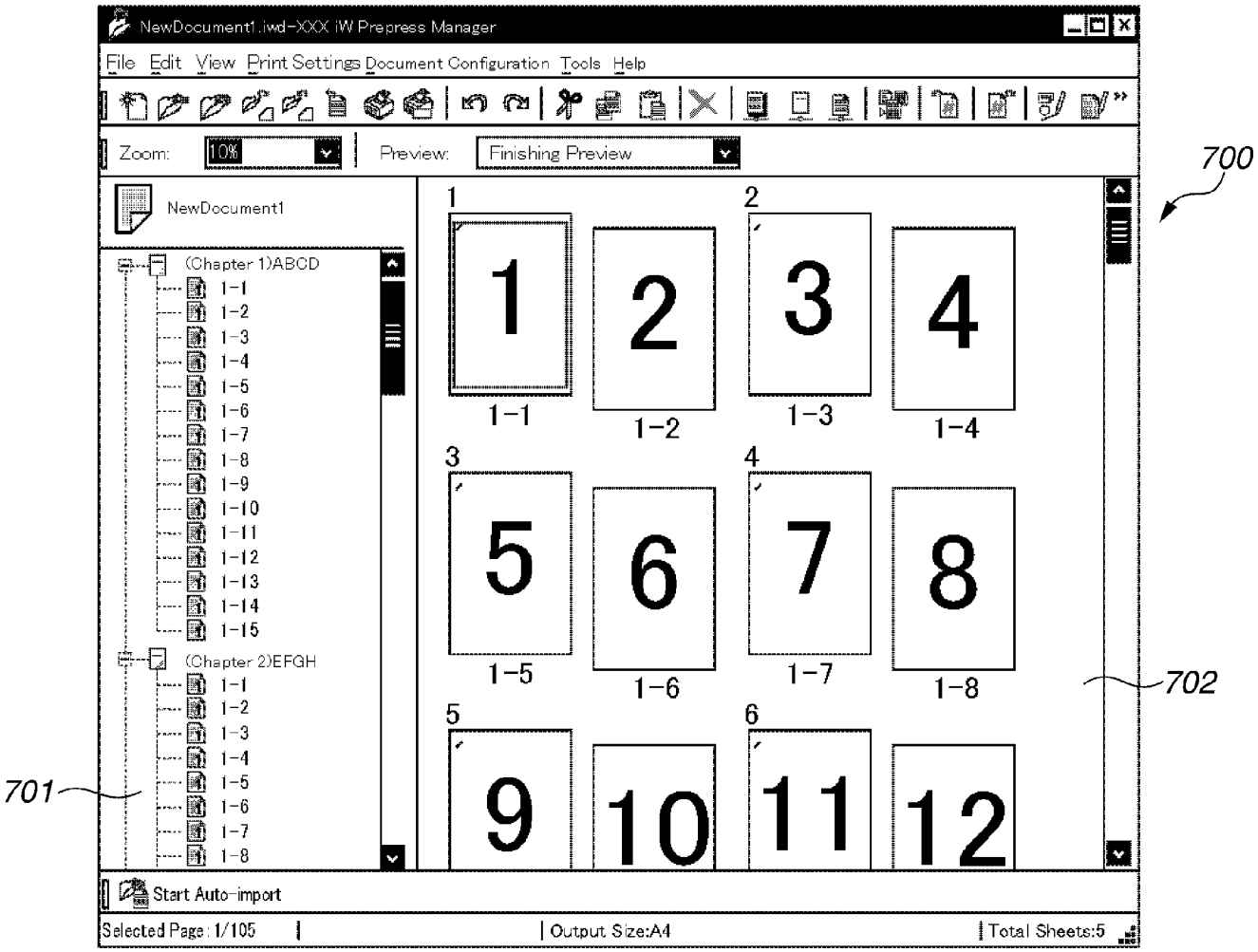
FIG. 7 illustrates an example of a user interface screen displayed when an existing book file is opened according to an exemplary embodiment of the present invention.

FIG. 7 illustrates an example of a user interface (UI) screen displayed according to the structure, an attribute, and the content of a book file opened by a user according to the present exemplary embodiment.

Referring to FIG. 7, a UI screen 700 is displayed under display control of the CRT 210 executed by the CPU 201 via the CRTC 206. The UI screen 700 includes a tree structure field 701 and a preview field 702. The tree structure field 701 displays the structure of a book. The preview field 702 displays a preview image, which is a predicted output of page data included in document data.

More specifically, the tree structure field 701 displays a chapter of a book and data of each page of a chapter in a tree-like structure. In FIG. 7, an original page is displayed in the tree structure field 701. The preview field 702 displays the content of a page to be printed as a reduced image. An order of displaying the images is determined according to the structure of the book.

In the tree structure field 701 and the preview field 702, setting verification images of different formats, which enable verification of the status of setting processing that has been designated on a book file such as binding processing, are displayed.

The bookbinding application 104 can generate a book file based on the application data in the above-described manner.

The following editing operations can be executed on a chapter and a page of the book file generated in the above-described manner.

(1) Adding a new chapter or page
(2) Deletion
(3) Copying
(4) Cutting
(5) Pasting
(6) Moving
(7) Renaming of chapter (8) Changing the page number or renaming the page name
(9) Inserting a front cover sheet
(10) Inserting a sheet
(11) Inserting an index sheet
(12) Designating the page layout to each original page In addition to the operations described above, an operation for cancelling the once designated editing operation and an operation for re-designating the once cancelled operation can be executed. By executing the above-described editing functions, editing operations, such as integrating with a plurality of book files, rearranging a chapter or a page within a book file, deleting a chapter or a page from a book file, changing a layout of an original page, and inserting a sheet or an index sheet, can be implemented.

After the above-described editing operation is executed, the result of the operation is applied to the attribute illustrated in FIGS. 4 through 6 or to the structure of the book file. For example, if a blank page is newly added, the blank page is inserted at a designated portion of the chapter. The inserted blank page is handled as an original page.

On the other hand, if the layout of an original page is changed, the content of the change is applied to the attribute, such as the printing method, N-up printing, the front cover/back cover, the index sheet, the inserted sheet, and the chapter break.

The book file that is generated and edited in the above-described manner is intended to be finally printed or output. When the user selects a file menu on the UI screen 700 (FIG. 7) of the bookbinding application and selects "print" from the menu, the book file is printed and output by a designated output device.

In this case, at first, the bookbinding application 104 generates a job ticket based on the currently opened book file and transmits the generated job ticket to the electronic original despooler 105. After receiving the job ticket, the electronic original despooler 105 converts the received job ticket into an output command of the OS, such as a GDI command of Windows®. The electronic original despooler 105 further transmits the converted command to the output module such as a GDI.

The output module generates a command that complies with the type of the device by using a designated printer driver 106 and transmits the generated command to the device. More specifically, a graphic engine of the output module loads the printer driver 106, which is provided to each printing apparatus, from the external memory 211 onto the RAM 202 and sets the output to the printer driver 106.

Then, the output module converts the received GDI function into a DDI function and then outputs the converted DDI function to the printer driver 106. The printer driver 106 converts the received DDI function into a control command that the printer 107 can interpret, such as a page description language (PDL).

The converted printer control command is then output, as print data, to the printer 107 via the system spooler loaded on the RAM 202 by the OS and the interface 21.

In the present exemplary embodiment, a job ticket is data having a structure in which an original page is a minimum unit. The structure of the job ticket defines the layout of the original page on the sheet. Furthermore, one job ticket is issued for each job.

Therefore, in the job ticket, a document node exists in the top layer, which defines the attribute of the entire document, such as the attribute "one-sided printing/two-sided printing". Below the document node, a sheet node exists which includes an attribute such as an identifier of a sheet to be used and designation of a sheet feed port of the printer. Each sheet node includes a node of a sheet to be printed on a paper sheet. One "sheet" included in the sheet node corresponds to one paper sheet.

Each "sheet" includes the attribute of a page to be printed (physical page). If one-sided printing is designated, one sheet includes one physical page. On the other hand, if two-sided printing is designated, then one sheet includes two physical pages. Each physical page includes an original page to be provided thereon. In addition, the layout of the original page is included in the attribute of the physical page.

Figure 8:
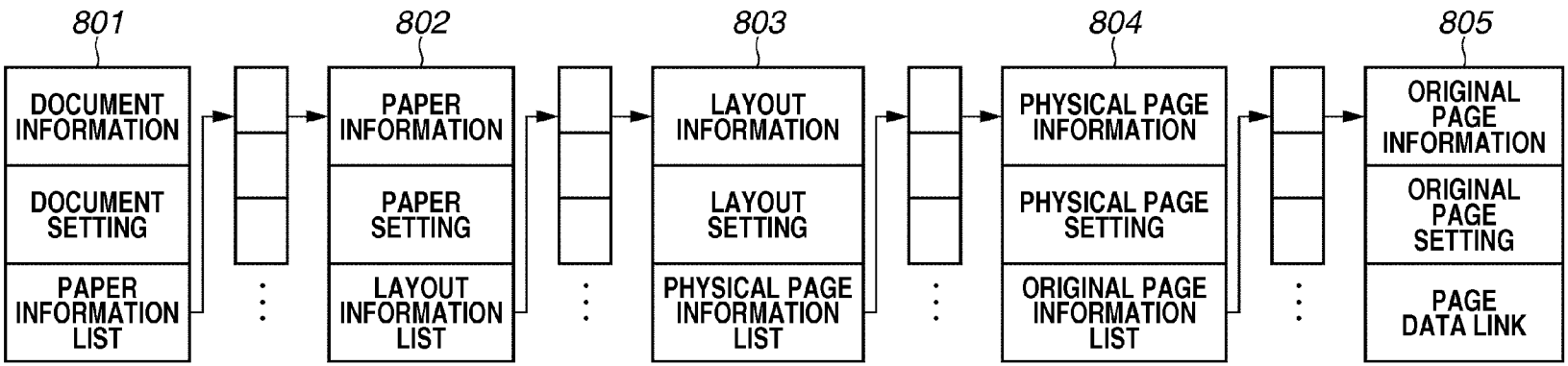
FIG. 8 illustrates an example of a data structure used when printing and a display are executed according to an exemplary embodiment of the present invention.

FIG. 8 illustrates an example of a data structure of a job ticket. In print data, a document includes an aggregate of sheets. Each sheet includes two sides of the sheet (the front and the back sides) according to the present exemplary embodiment. Each of the front and the back sides includes an area in which the document is laid out (physical page). Each physical page includes an aggregate of original pages, which is the minimum unit thereof.

Referring to FIG. 8, document 801 is data corresponding to a document. The document 801 includes a list of information about the sheets constituting the document (i.e., document information, document setting, and paper information list). Paper 802 includes information about the sheet (paper information, such as the paper size, paper setting, and a list of information about a sheet space which is laid out on the sheet (i.e., layout information list).

Sheet layout 803 includes layout information unique to a sheet space, layout setting and a list of physical page information about the physical page to be imposed on the sheet space (i.e., physical page information list). Physical page 804 includes physical page information such as the size and the header and footer of the physical page, physical page setting, and a list of original page information, which is information about the original pages constituting the physical page (i.e., original page information list.

Original page 805 includes information about the original page (e.g., original page information), original page setting, etc.) and a link to data of the original page (e.g., page data link).

The electronic original despooler 105 converts the job ticket into the output command to the output module. As described above, when a book file is opened by the bookbinding application 104, the CPU 201 controls the CRT (display apparatus) 210 via the CRTC 206 to display the UI screen 700 (FIG. 7).

The tree structure field 701 of the UI screen 700 displays a tree that indicates the structure of the currently opened book (hereinafter referred to as a "target book"). The preview field 702 includes four different display methods that can be designated by the user as desired. A first display method is an "original view mode". In the original view mode, the content of the original page data of the target book is reduced and displayed as it is without displaying the layout of the original page in the preview field 702.

A second display method is a "print view mode". In the print view mode, the original page is displayed in the preview field 702 in a state in which the layout of the original page is applied.

A third display method is a "simple print view mode". In the simple print view mode, the content of each original page is not applied in the display in the preview field 702 and only the layout thereof is displayed.

A fourth display method is a "sheet preview mode". In the sheet preview mode, a predicted output of data of each page is displayed as a setting verification image. A "setting verification image" enables the user to verify the status of setting set for data of a plurality of pages. In addition, in the sheet preview mode, a binding mark, which indicates that binding processing has been set, is displayed.

Figure 9:
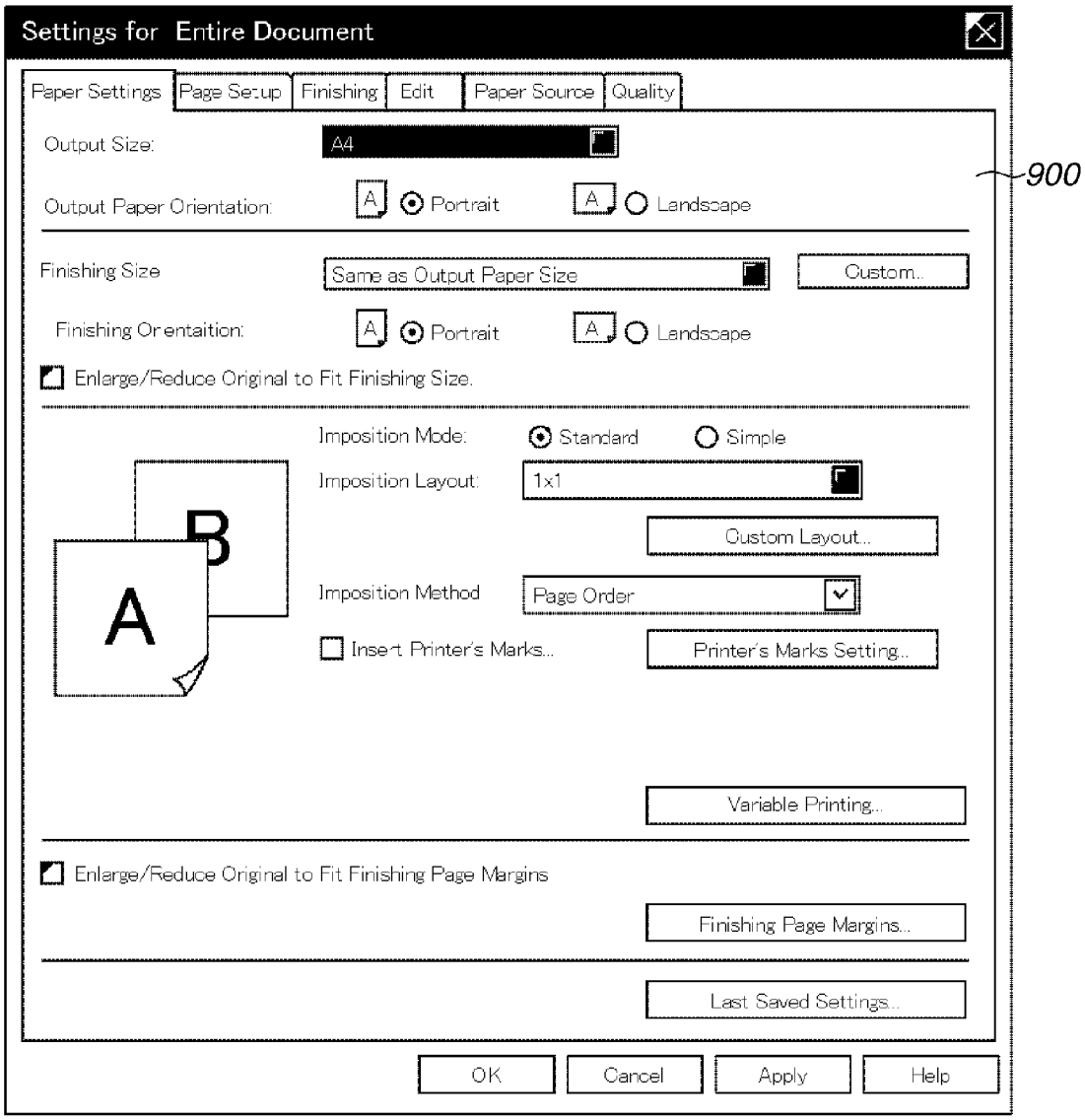
FIG. 9 illustrates an example of a dialog window for executing a setting of a book, which is the top layer of the data structure, according to an exemplary embodiment of the present invention.

FIG. 9 illustrates an example of a "settings for entire document" window 900 of the bookbinding application 104 according to the present exemplary embodiment. The user can display and set the document setting information 303 via the "settings for entire document" window 900.

The "settings for entire document" window 900 is called from a "settings for entire document" menu in a "print settings menu" displayed on the UI screen (application operation screen) 700 (FIG. 7). The user can execute setting of an attribute that may be effective for the entire document via the "settings for entire document" window 900.

The "settings for entire document" window 900 includes six tabbed setting sheets, namely, a "paper settings" sheet, a "page setup" sheet, a "finishing" sheet, an "edit" sheet, a "paper source" sheet, and a "quality" sheet. In the example illustrated in FIG. 9, the "paper settings" sheet is displayed.

In the "paper settings" sheet, the user can primarily execute a setting related to the layout (imposition). More specifically, the user can issue an instruction for setting the output paper size and the output paper orientation.

Figure 10:
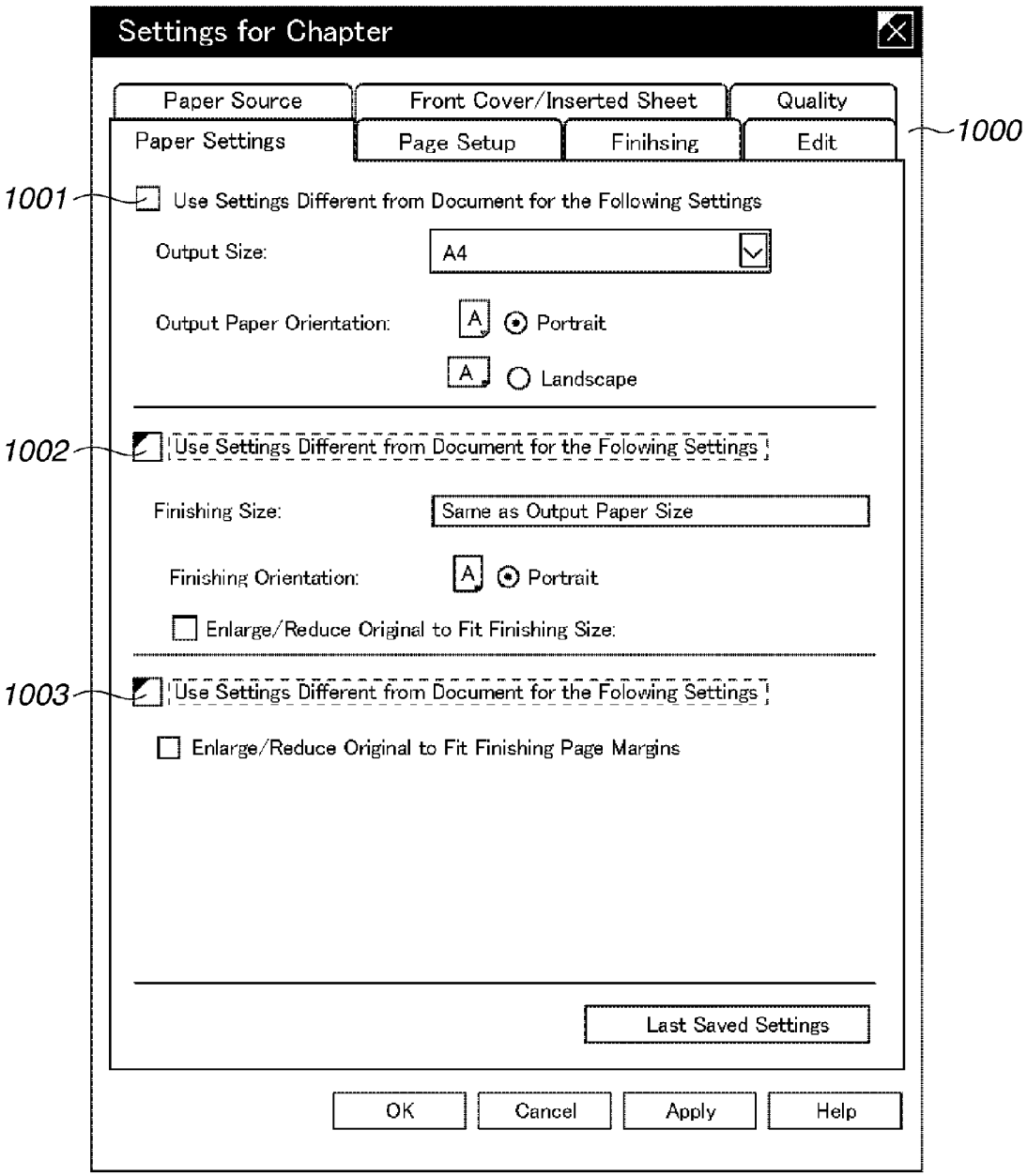
FIG. 10 illustrates an example of a dialog window for executing a setting of a chapter, which is a middle layer of the data structure, according to an exemplary embodiment of the present invention.

FIG. 10 illustrates an example of a "settings for chapter" window 1000 of the bookbinding application 104 according to the present exemplary embodiment. In the "settings for chapter" window 1000, the user can display and set the chapter setting information 307. The "settings for chapter" window 1000 is called from a "settings for chapter" menu in the "print settings menu" displayed on the UI screen (application operation screen) 700 (FIG. 7). The user can execute setting of an attribute unique to a chapter via the "settings for chapter" window 1000.

The "settings for chapter" window 1000 includes seven tabbed setting sheets, namely, a "paper settings" sheet, a "page setup" sheet, a "finishing" sheet, an "edit" sheet, a "paper source" sheet, a "front cover/inserted sheet" sheet, and a "quality" sheet. In the example illustrated in FIG. 10, the "paper settings" sheet is displayed.

The user can primarily execute a setting for a sheet, which can be set uniquely set for each chapter via the "paper settings" sheet. More specifically, the user can issue an instruction for setting the output paper size, the output paper orientation, and the finishing size via the "paper settings" sheet.

"Use settings different from document for the following settings" check boxes 1001 through 1003 can be checked by the user to execute setting of setting items that can be set in common to the settings for the entire document and the settings for a chapter.

With respect to items whose corresponding check box 1001, 1002, or 1003 has been checked, a value set via the "settings for chapter" window 1000 is applied to the corresponding chapter instead of applying a setting value set for the document.

The settings that can be uniquely set for a chapter includes two broad types. One type is a setting item that can be set for a chapter only. The other is a setting item for a chapter that has a specific setting value different from that for a document, which is an upper layer thereof.

Figure 11:
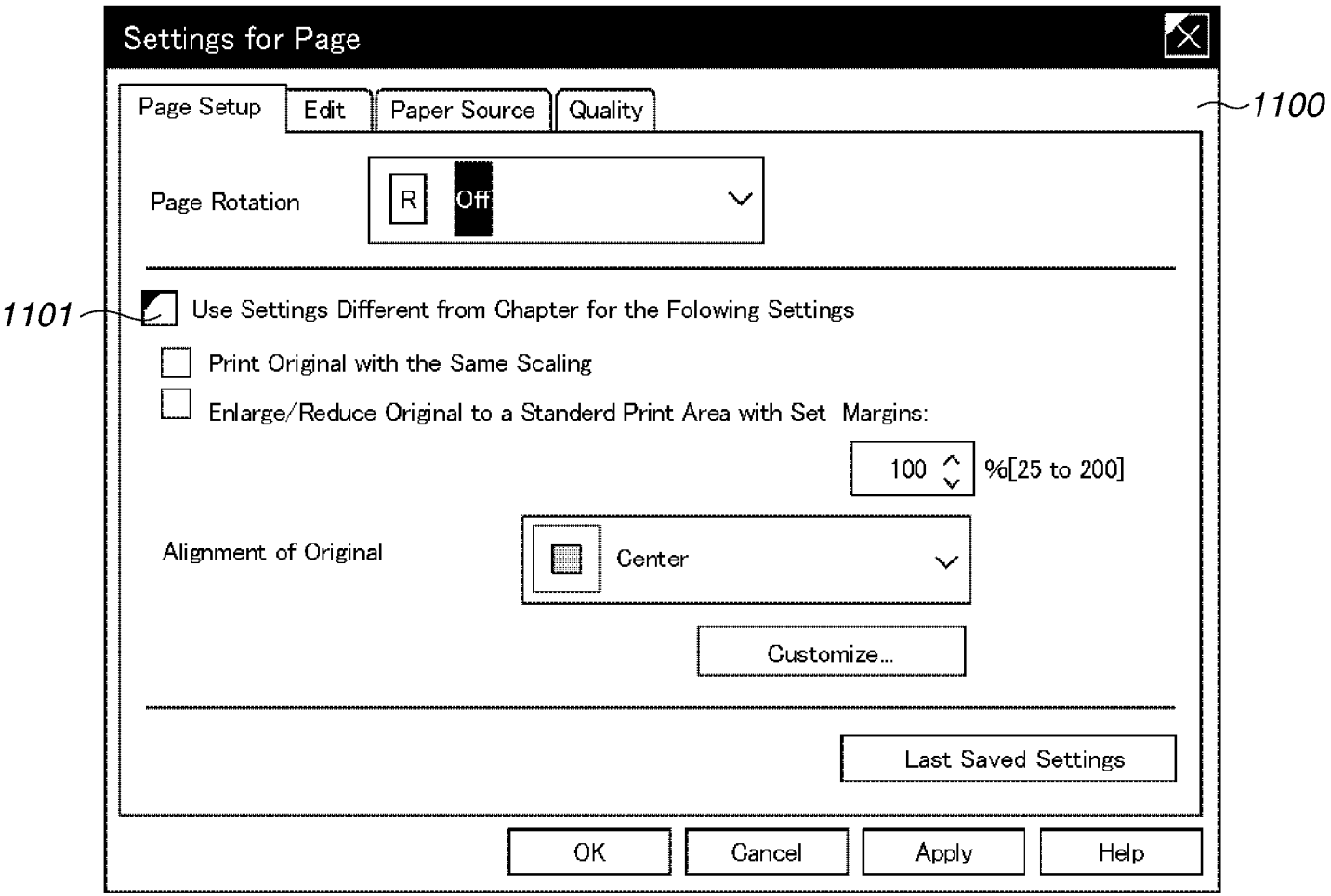
FIG. 11 illustrates an example of a dialog window for executing a setting of a page, which is the bottom layer of the data structure, according to an exemplary embodiment of the present invention.

FIG. 11 illustrates an example of a "settings for page" window 1100 of the bookbinding application 104 according to the present exemplary embodiment. The user can display and set the page setting information 311 via the "settings for page" window 1100.

The window is called by pressing a "settings for page" button on a "settings for page" menu in the "print settings" menu or a tool bar displayed on the application operation screen 700 (FIG. 7).

The "settings for page" window 1100 is a window for setting an attribute uniquely set for each page. The "settings for page" window 1100 includes four tabbed setting sheets, namely, a "page setup" sheet, an "edit" sheet, a "paper source" sheet, and a "quality" sheet. In the example illustrated in FIG. 11, the "page setup" sheet is displayed.

The user can primarily execute a setting of a layout (imposition) uniquely set for each page via the "settings for page" window 1100. More specifically, the user can issue an instruction for setting a rotational angle and an enlargement/reduction ratio of an original page to be imposed on the printing sheet.

A "use settings different from chapter for the following settings" check box 1101 can be checked by the user to execute setting of setting items that can be set in common to the settings for a chapter and the settings for a page. With respect to the setting item whose "use settings different from chapter for the following settings" check box 1101 has not been checked, the setting value for a chapter is applied to the page.

It is useful to store control information for the "use settings different from chapter for the following settings" check box 1101, which is set by the user via the "settings for page" window 1100 in a previously provided dedicated storage area. It is more useful if the control information for the "use settings different from chapter for the following settings" check box 1101 is stored within the setting information illustrated in FIG. 3 as one of the attributes. In this case, the examples illustrated in FIGS. 5 and 6 additionally include an area for storing the control information for the "use settings different from chapter for the following settings" check box 1101.

Figure 12:
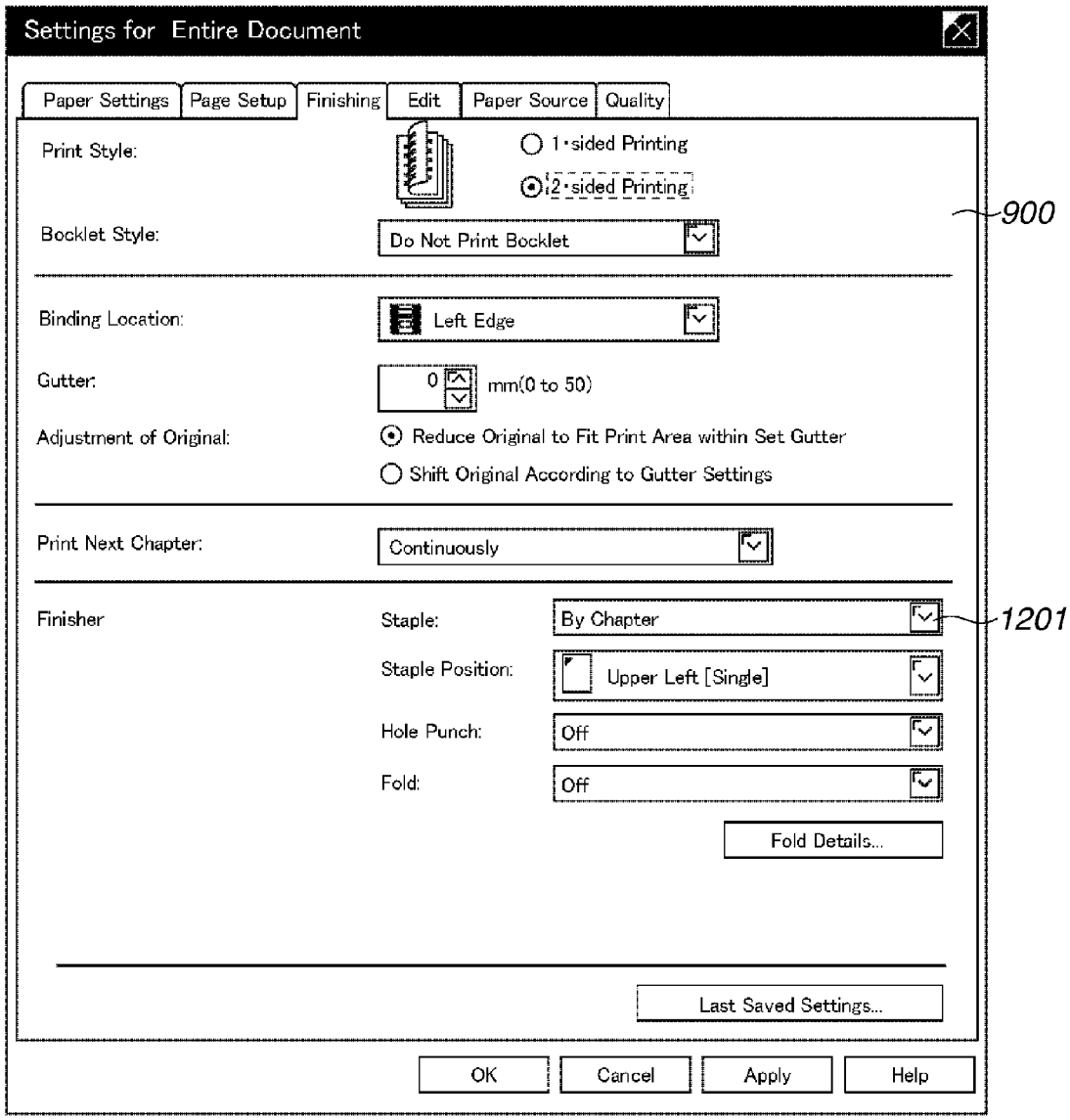
FIG. 12 illustrates an example of a screen displayed when changing a setting value of stapling on the dialog window illustrated in FIG. 9 according to an exemplary embodiment of the present invention.

FIG. 12 illustrates an example of a display on the "settings for entire document" window 900 of the bookbinding application 104, in which the user has designated the setting for executing stapling processing. If the user has designated to execute stapling processing, then the CPU 201 sets stapling processing on a book file (document data).

In the present exemplary embodiment, stapling processing is implemented as an example of binding processing for binding a part of document data as a partial binding set. However, the present invention is not limited to this. More specifically, the present invention, which will also be described in detail below, can implement binding processing other than the stapling processing, such as punching processing, case-binding processing, or ring-binding processing.

A "staple" combo box 1201 of the "finishing" sheet includes four alternatives, namely, "off", "all page at once", "by chapter", and "group copies of same page".

If "off" is selected, then "disable stapling" is set. If "all pages at once" is selected, then "staple by copy" is set. If "by chapter" is selected, then "staple by chapter" is set. If "group copies of same page" is selected, then "staple on same page of a plurality of copies by the number equivalent to the number of copies" is set.

More specifically, the CPU 201 sets the above-described setting according to the user operation.

In the example illustrated in FIG. 12, the user has opened (designated) the "finishing" sheet and has set "by chapter" stapling as the setting for the item "staple". The CPU 201 sets stapling processing for a binding processing (document data) according to the above-described user designation.

Figure 13:
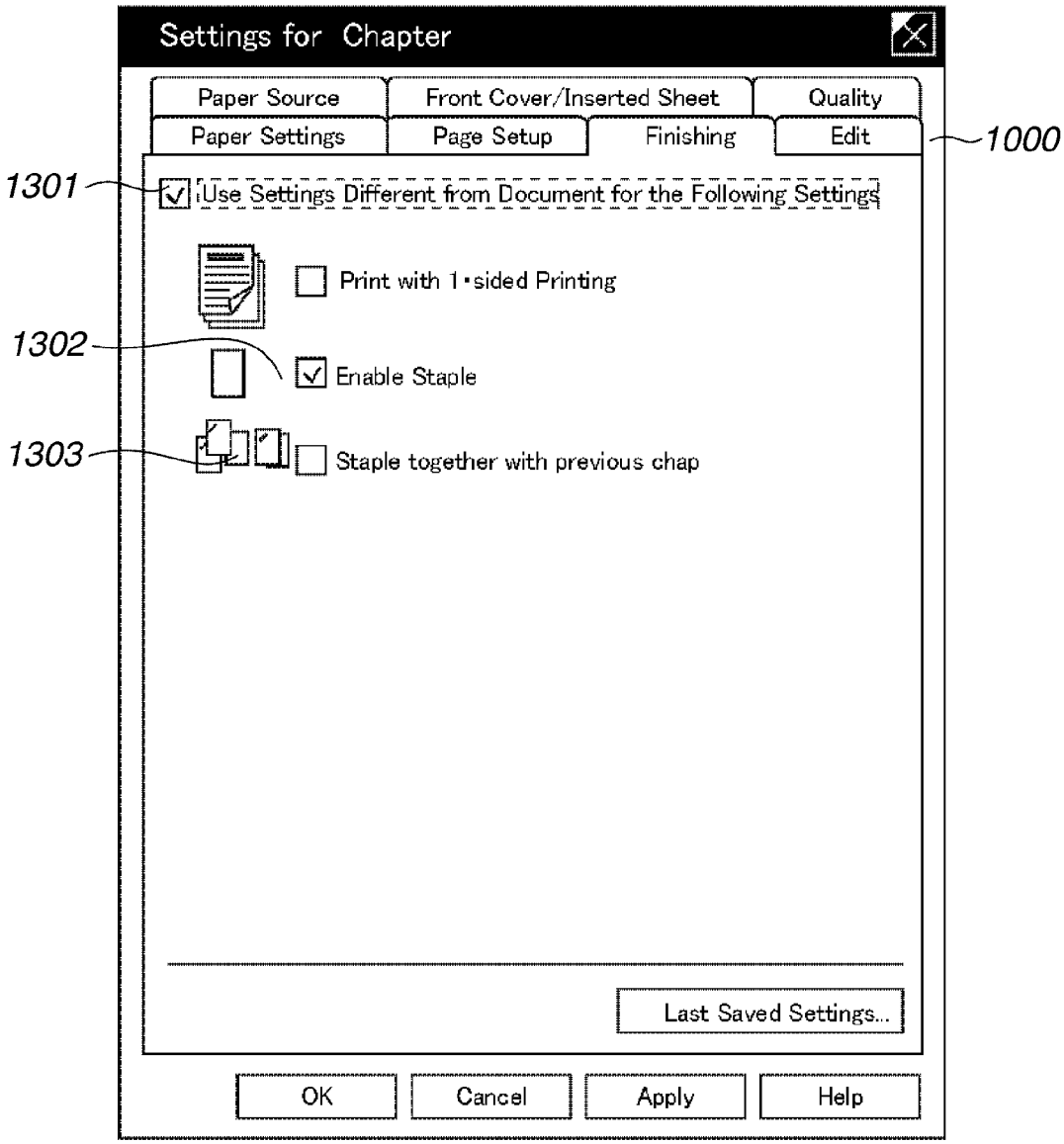
FIG. 13 illustrates an example of a screen displayed when changing a setting value of stapling on the dialog window illustrated in FIG. 9 according to an exemplary embodiment of the present invention.

FIG. 13 illustrates the "settings for chapter" window 1000 of the bookbinding application 104 called by the user, in which stapling of a chapter has been set by the user. In the example illustrated in FIG. 13, a "use settings different from document for the following settings" check box 1301 of the "finishing" sheet has been checked. Accordingly, a setting unique to the chapter can be set. The user can enable (disable) an "enable staple" check box 1302 to execute (not to execute) stapling of the chapter.

In addition, the user can enable (disable) a "staple together with previous chapter" check box 1303 to execute (not to execute) stapling together with a previous chapter.

If the check box 1302 is checked for a first chapter and if the check box 1302 is checked and the check box 1303 is not checked for a second chapter, then the first and the second chapters are set as different staple sets.

Furthermore, if both the check boxes 1302 and 1303 are checked for a subsequent chapter in this case, then the first, the second, and the subsequent chapters are stapled as one partial staple set.

If the check box 1302 is not checked for the first chapter and if the check box 1303 is checked for the second chapter, the first and the second chapters are not to be stapled as one partial staple set because the first chapter is not designated to be stapled. Accordingly, the check box 1303 may not be effective if the setting of stapling for a previous chapter is not enabled. Therefore, if stapling is not designated to be executed on a previous chapter or if the chapter is a first chapter, which has no previous chapter, it is useful if the check box 1303 is disabled.

The above-described setting of stapling processing can be executed by the user by operating the KB 209 and a pointing device (not illustrated). The CPU 201 executes the setting set by the user according to the received user operation.

In addition, the information set by the CPU 201 is stored in an each page data-stapling state table 1801 illustrated in FIG. 18. The RAM 202 stores the stapling state table 1801.

The CPU 201 reads and displays the stapling state table 1801 to allow the user to verify what type of stapling setting is executed on each page data.

Figure 15:
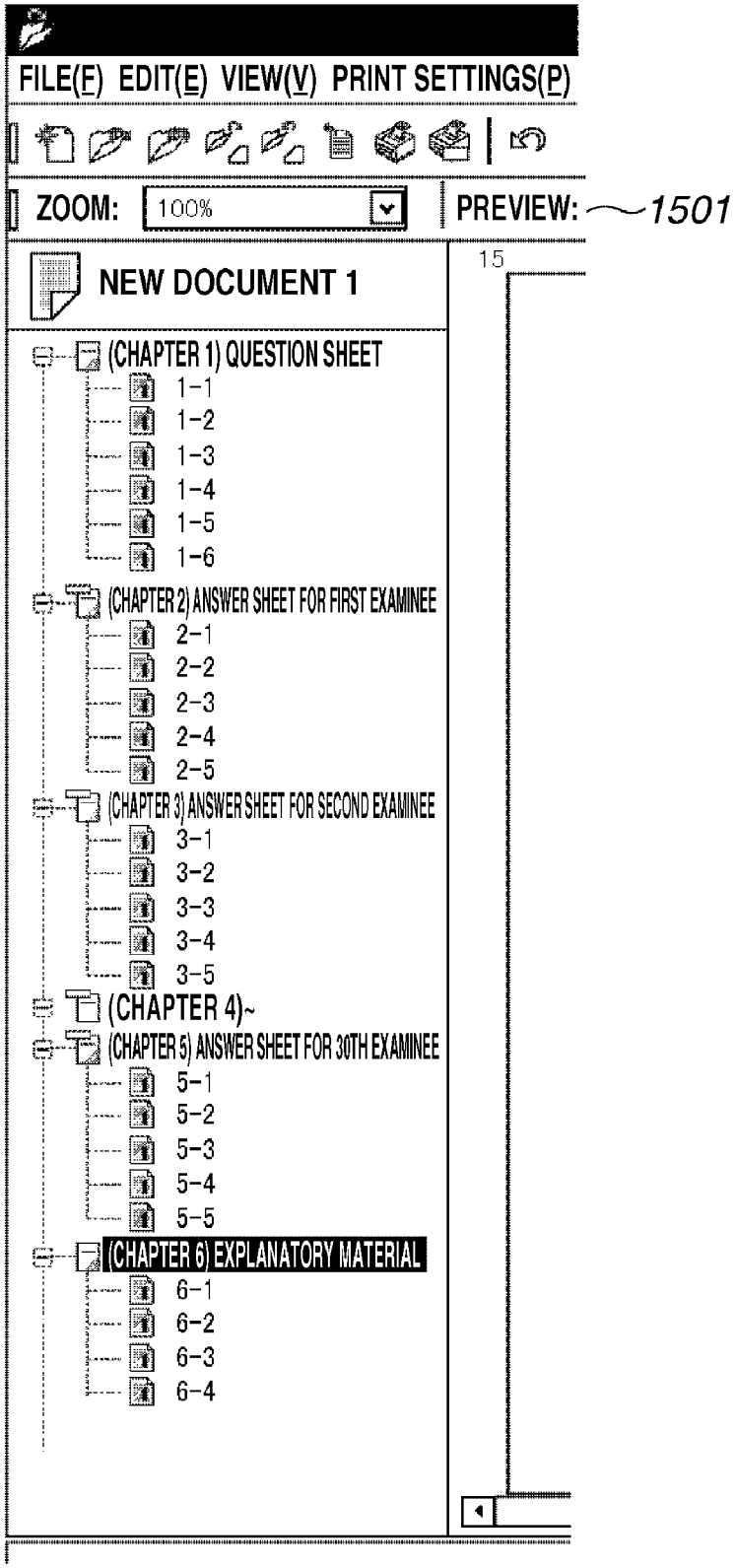
FIG. 15 illustrates a conventional display executed for designating a subset in a document processing system.

FIG. 14 illustrates an example of partial (or subset) stapling according to the present exemplary embodiment. FIG. 15 illustrates an example of a tree view screen 1501 of the document processing system when the partial stapling illustrated in FIG. 14 has been designated according to the present exemplary embodiment.

In the examples illustrated in FIGS. 14 and 15, the setting for stapling is set for a print job including one-page question sheet for thirty examinees, five stapled pages of answer sheet for thirty examinees in total, and one-page explanatory material for four persons of explaining staff.

Figure 16:
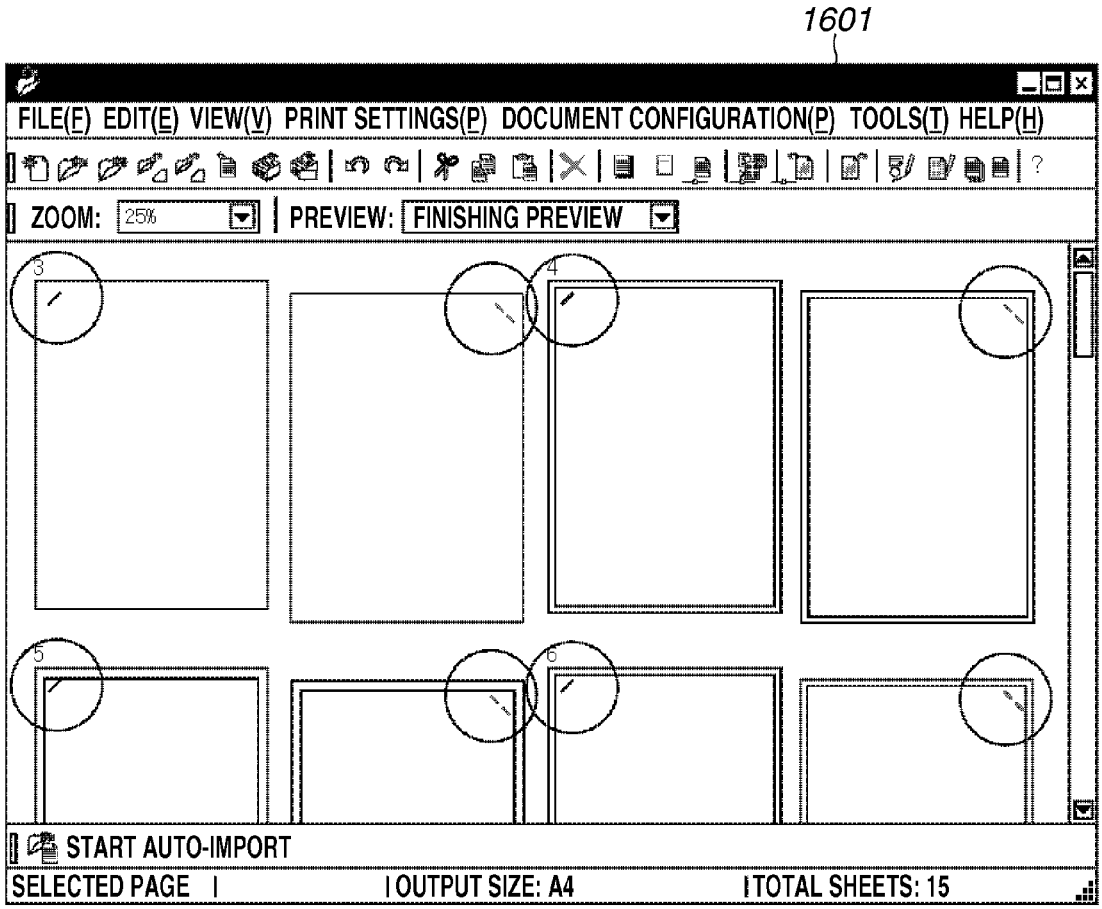
FIG. 16 illustrates a conventional display executed for designating stapling on a sheet preview screen.

FIG. 16 illustrates a staple mark displayed on a sheet preview screen (finishing preview screen) 1601 according to a conventional method.

In the conventional method illustrated in FIG. 16, the user can know that each page is stapled but cannot know a break between partial staple sets if partial staples have been set.

Figure 17:
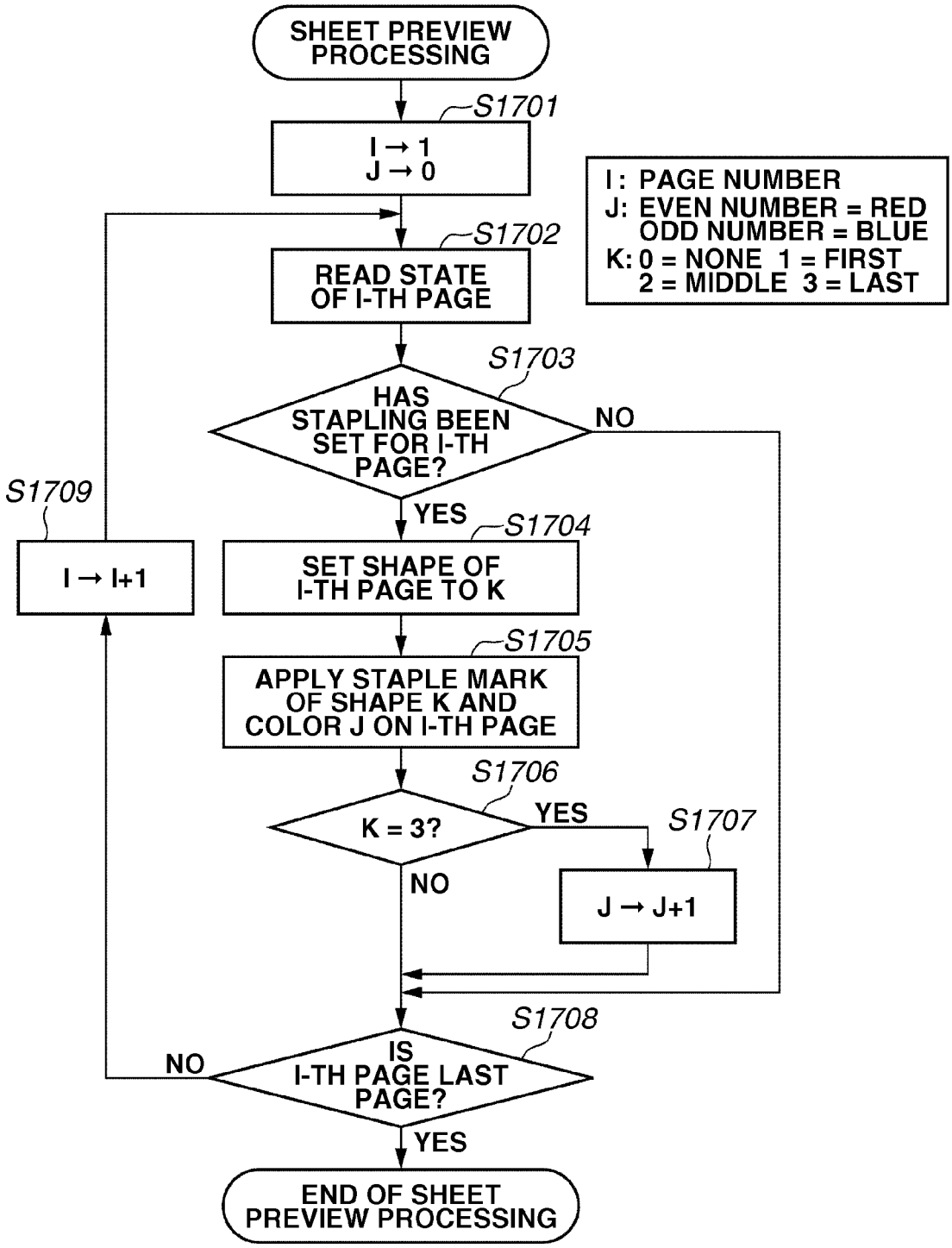
FIG. 17 is a flow chart illustrating an example of processing for displaying a preview screen according to an exemplary embodiment of the present invention.

FIG. 17 is a flow chart illustrating an example of processing for displaying a staple mark displayed on a sheet (finishing) preview screen for previewing each page according to an exemplary embodiment of the present invention.

Referring to FIG. 17, in step S1701, the CPU 201 detects that the display of the sheet preview has been designated by the user by operating the KB 209 and the pointing device (not illustrated). In addition, the CPU 201 finally determines a value for each of variables "I" and "J" to allow the user to verify the state of designation of each page from the first page. The variable "I" denotes a page number of the first page. The variable "J" denotes the color of the staple mark. Furthermore, the CPU 201 stores the determined values on the RAM 202.

In step S1702, the CPU 201 refers to the stapling state table 1801 to read and acquire the state of the page I.

In step S1703, the CPU 201 determines whether stapling processing has been designated for the page I. If it is determined that stapling processing has been designated for the page I (YES in step S1703), then the processing advances to step S1704. On the other hand, if it is determined that stapling processing has not been designated for the page I (NO in step S1703), then the processing advances to step S1708.

In step S1704, the CPU 201 sets a value of a variable "K" according to the shape of the staple acquired from the stapling state table 1801. The variable K denotes the shape of a staple mark to be displayed on the page I.

In the present exemplary embodiment, if it is determined that the shape of the staple acquired from the stapling state table 1801 is "first", which indicates a first page of the partial staple set, then the CPU 201 sets "1" as the value of the variable K. On the other hand, if it is determined that the shape of the staple acquired from the stapling state table 1801 is "middle", which indicates a middle page of the partial staple set, then the CPU 201 sets "2" as the value of the variable K. In addition, if it is determined that the shape of the staple acquired from the stapling state table 1801 is "last", which indicates a last page of the partial staple set, then the CPU 201 sets "3" as the value of the variable K.

In step S1705, the CPU 201 executes control for displaying the staple mark having a predetermined color and shape according to the values of the variables K and J of the page I (i.e., apply stable mark of shape K and color J on I-th page).

In the present exemplary embodiment, if the variable J has a value of an even number, then the color of the staple mark is blue. On the other hand, if the variable J has a value of an odd number, then the color of the staple mark is red. However, the present exemplary embodiment is not limited to this. More specifically, it is also useful if arbitrary three or more colors are used to allow the user to identify the difference between the staple marks.

In addition, it is also useful if different colors are used for partial staple sets existing adjacent to one another without page data to which stapling processing has not been designated by the user among them. In this case, the same color can be used for partial staple sets other than those existing adjacent to one another without page data to which stapling processing has not been designated by the user among them.

Alternatively, it is also useful if the same color is used even for the partial staple sets existing adjacent to one another to which different types of stapling have been set. In this case, different colors can be used for the partial staple set existing adjacent to one another to which the same type of stapling has been set.

As described above, the present exemplary embodiment uses different colors for binding marks (staple marks) existing adjacent to one another. Accordingly, the user can identify each of and distinguish between the partial binding sets. The shape of a staple will be described in detail below.

In step S1706, the CPU 201 determines whether the variable K has a value "3". If it is determined that the variable K has a value "3" (YES in step S1706), then the processing advances to step S1707. On the other hand, if it is determined that the variable K does not have a value "3" (NO in step S1706), then the processing advances to step S1708.

In step S1707, in which the CPU 201 has determined that the variable K has a value "3", the CPU 201 determines that the page I, which is the current target page, is the last page of the partial staple set. Accordingly, in step S1707, the CPU 201 increments the variable J by 1 to change the color of the staple for a subsequent partial staple set.

In step S1708, the CPU 201 determines whether the page I is the last page of the document data. If it is determined that the page I is not the last page of the document data (NO in step S1708), then the processing advances to step S1709. On the other hand, if it is determined that the page I is the last page of the document data (YES in step S1708), then the processing ends.

In step S1709, the CPU 201 increments the variable I by 1 to execute the finishing preview of subsequent page data of the document data. Then, the processing returns to step S1702.

The present exemplary embodiment executes the processing in the above-described manner. Accordingly, if a plurality of partial staple sets has been set, the user can identify each of and distinguish among partial staple sets on the finishing preview screen according to the shape or the color of the staple mark.

If the setting of the staple position is available, it is also useful if information about the staple position is recorded in the stapling state table 1801. In this case, the CPU 201 can set and apply the staple position on the display in step S1704 at the same time as setting and applying the shape of the staple on the display. For the staple position that can be set, parameters, such as single point binding including "upper-left binding" and "upper-right binding", longer side two-point binding, and saddle stitch binding in the case of bookbinding printing, can be set.

Suppose here that two-sided printing has been designated, that an odd-numbered page is the front surface of the sheet, and that the user has designated the stapling processing for "upper-left binding". In this case, it is useful that the staple mark is displayed in the upper-left portion of the sheet of the odd-numbered page and that the staple mark is displayed in the upper-right portion of the sheet of an even-numbered page, which corresponds to the back surface of the sheet.

With the above-described configuration, the present exemplary embodiment can implement the preview display that can allow the user to intuitively and easily recognize the displayed content.

Figure 19:
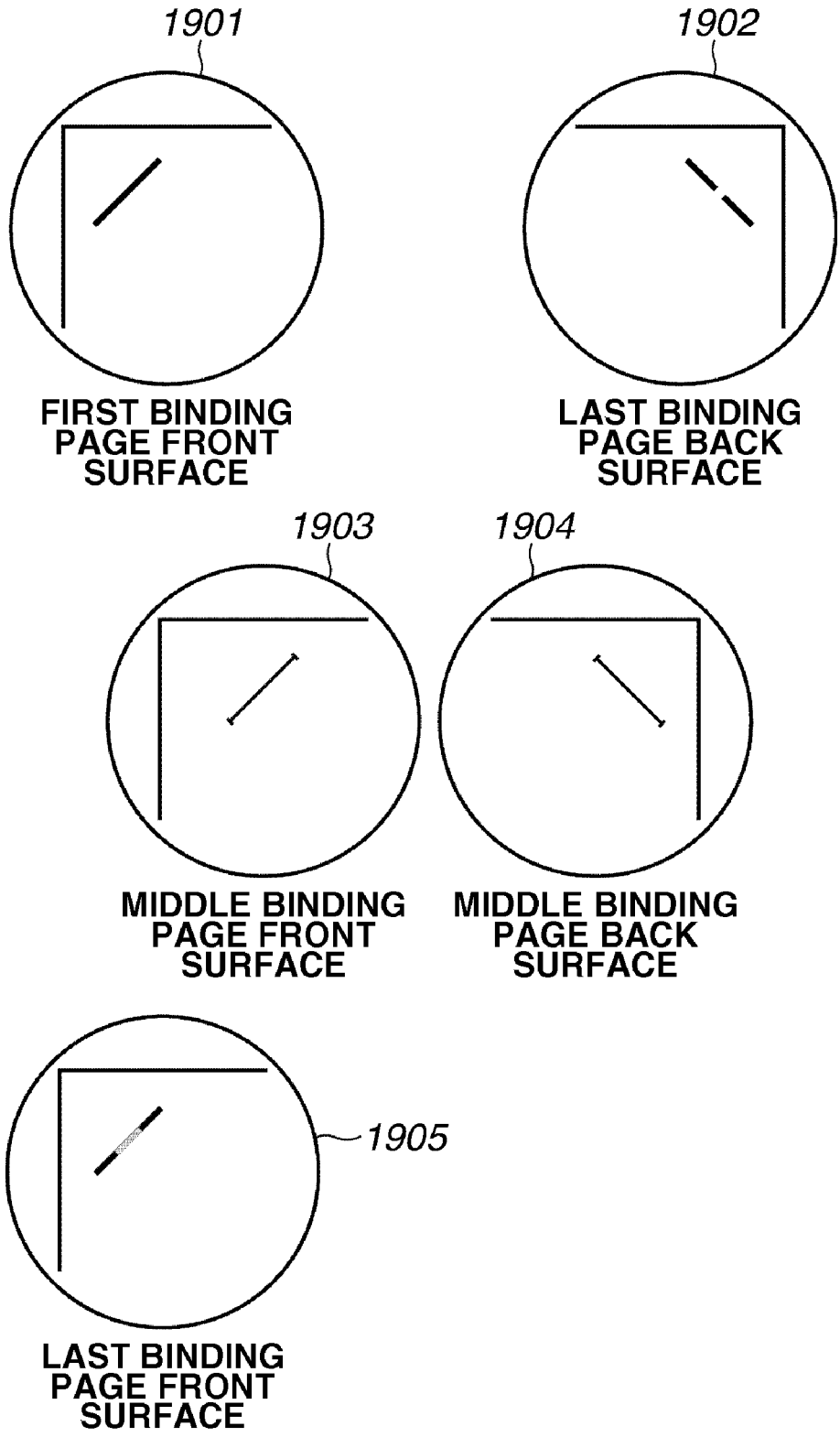
FIG. 19 illustrates an example of a type of a staple mark when partial stapling is designated according to an exemplary embodiment of the present invention.

FIG. 19 illustrates an example of the shape of a staple mark according to the present exemplary embodiment.

Referring to FIG. 19, a staple mark (a first binding mark) 1901 is a staple mark for the first page of a partial stapling set (e.g., first binding page front surface). The staple mark 1901 is displayed with a thick solid line.

A staple mark (a second binding mark) 1902 is a staple mark for the last page of the partial stapling set (e.g., last binding page back surface). The staple mark 1902 is displayed with a thick broken line.

In addition, staple marks (third binding marks) 1903 and 1904 are staple marks for middle pages of the partial staple set. The staple marks 1903 and 1904 are displayed by thick points at both ends of the staple mark and a thin (light-color) straight line connecting the points. The staple marks 1903 and 1904 respectively indicate the staple mark for the front surface of the sheet and the staple mark for the back surface thereof (i.e., middle binding page front and page back surfaces, respectively).

The staple mark 1905 is displayed as a staple mark for the front surface of the last page of the partial staple set if the document data is data used in one-sided printing and the back surface is not displayed on the finishing preview screen (i.e., last binding page front surface). The staple mark 1905 is displayed by a thick broken line and a light (or thin) straight line existing between the broken portions of the broken line.

In the processing according to the flow chart illustrated in FIG. 17, if K=1, then the staple mark 1901 is displayed. Similarly, if K=2, then the staple mark 1903 or 1904 is displayed. Furthermore, if K=3, then the staple mark 1902 is displayed. The staple marks 1901 through 1905 illustrated in FIG. 19 are mere examples and the present exemplary embodiment is not limited to this configuration. More specifically, any other staple marks having a shape or color other than those described above can be displayed if the configuration can allow the user to identify each of and distinguish between a plurality of partial staple sets.

As described above, the present exemplary embodiment uses binding marks (staple marks) having different shapes such as the above-described first through third binding marks. Accordingly, the user can intuitively and easily identify each of and distinguish between a plurality of partial staple sets.

Figure 20:
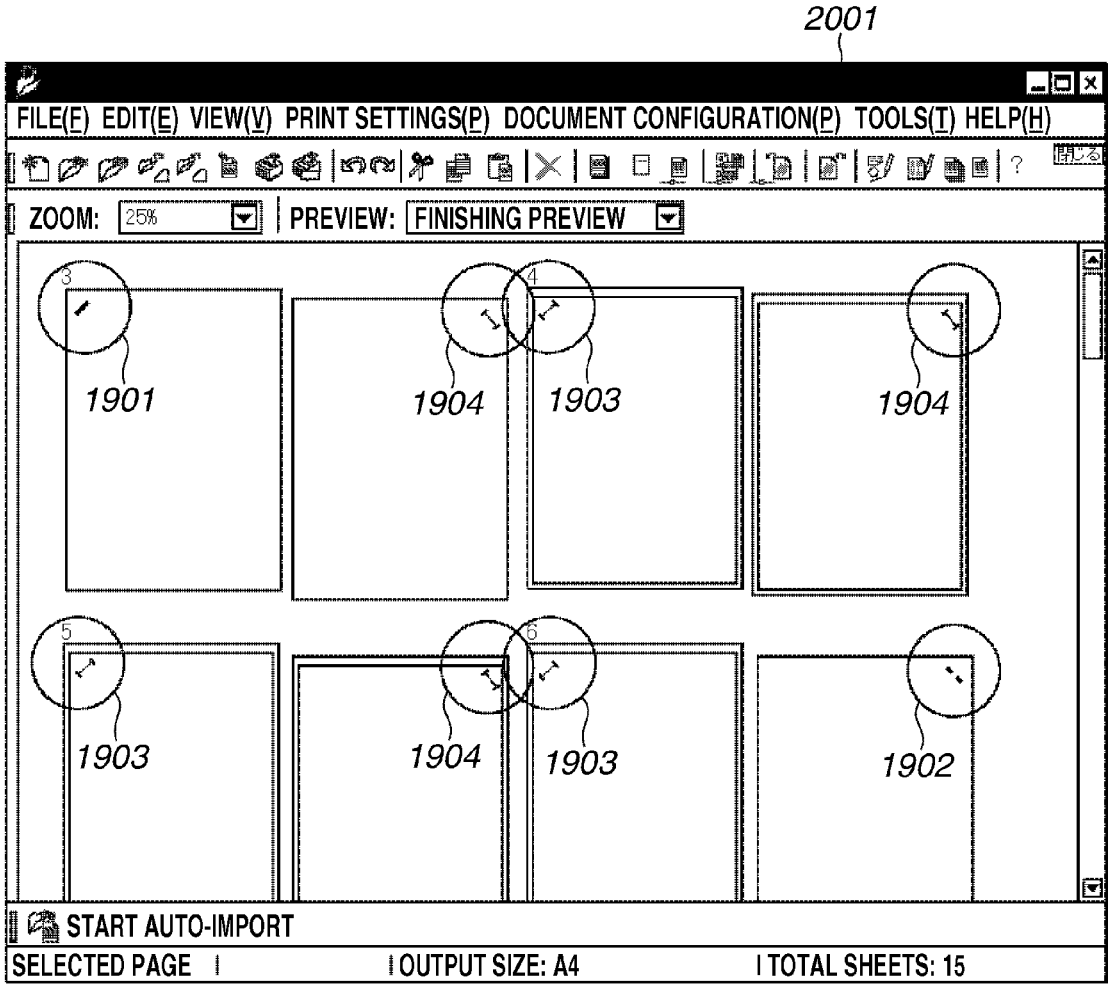
FIG. 20 illustrates a display example 1 executed for designating stapling on a sheet preview screen according to an exemplary embodiment of the present invention.
Figure 21:
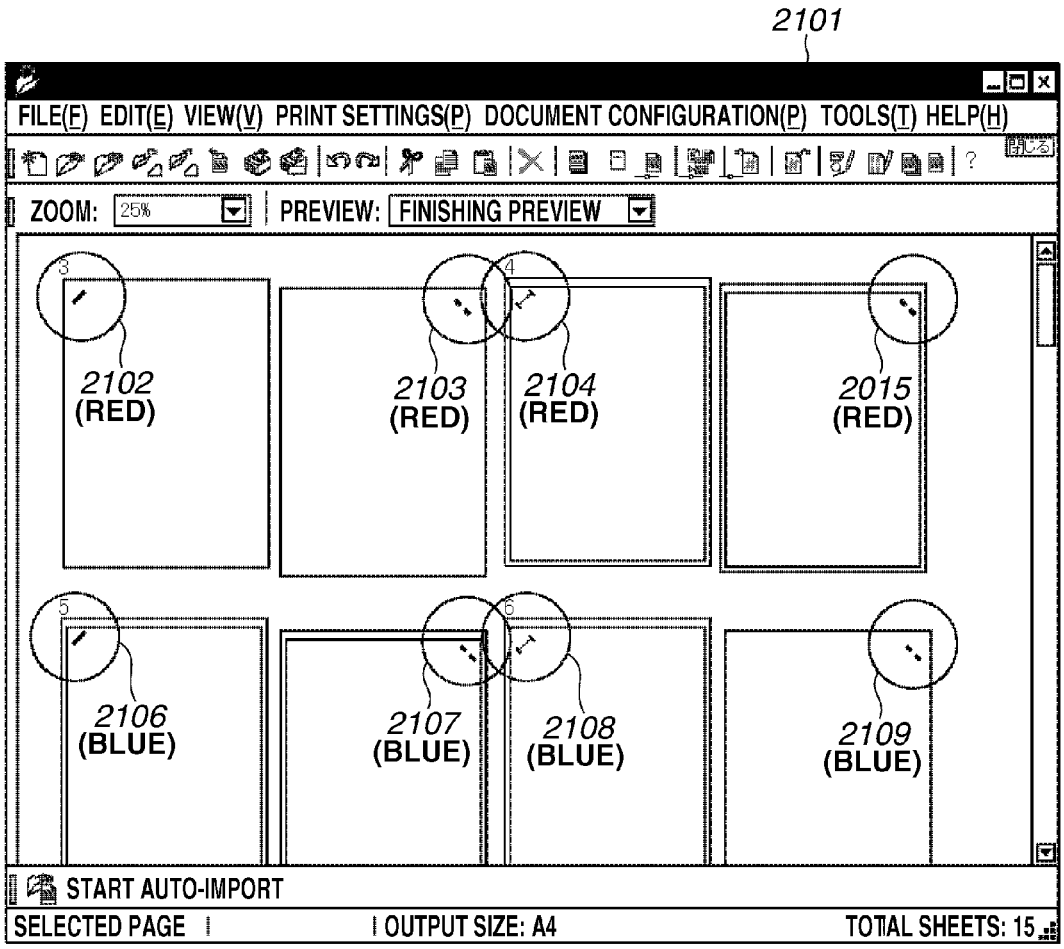
FIG. 21 illustrates a display example 2 executed for designating stapling on a sheet preview screen according to an exemplary embodiment of the present invention.

FIGS. 20 and 21 respectively illustrate an example of the display of the staple mark on the finishing preview screen according to the present exemplary embodiment.

Referring to FIG. 20, a finishing preview screen 2001 displays a preview of one partial staple set. In the example illustrated in FIG. 20, the page displayed in the upper-left portion of the screen corresponds to the front surface page, which is the first page of the partial staple set. Subsequent six pages correspond to middle pages. The page displayed in the lower-right portion of the screen corresponds to the last page of the partial staple set. In addition, in the finishing preview screen 2001, each page has a staple mark having a corresponding shape.

FIG. 21 illustrates a finishing preview screen 2101 according to the present exemplary embodiment. In the finishing preview screen 2101, different partial staple sets are displayed in the upper portion and the lower portion thereof.

In the example illustrated in FIG. 21, a red staple mark is displayed as the staple mark for the partial staple set displayed on the upper portion of the finishing preview screen 2101 while a blue staple mark is displayed as the staple mark for the partial staple set displayed on the lower portion thereof. Accordingly, the user can highly easily identify each partial staple set.

Figure 22:
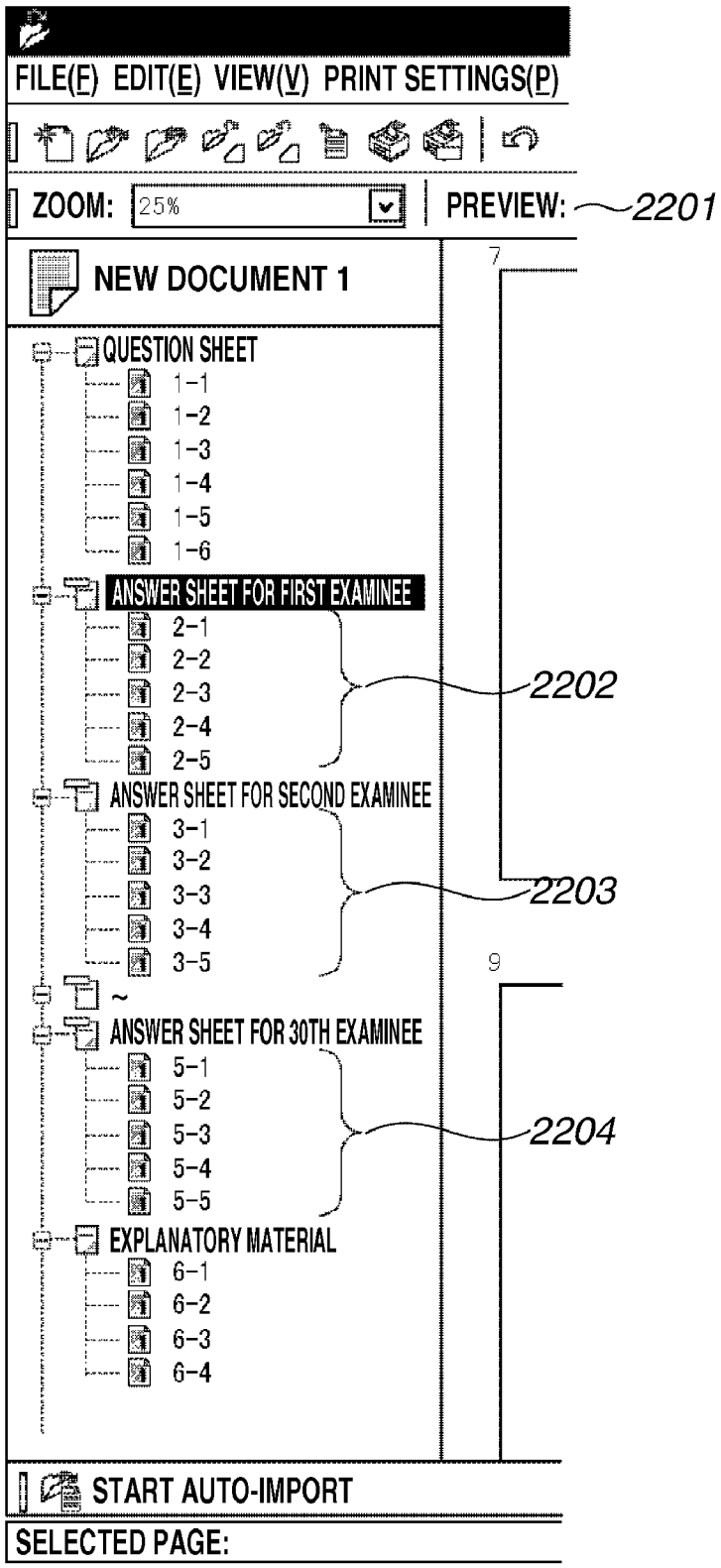
FIG. 22 illustrates a display example 1 of a tree view according to an exemplary embodiment of the present invention.
Figure 23:
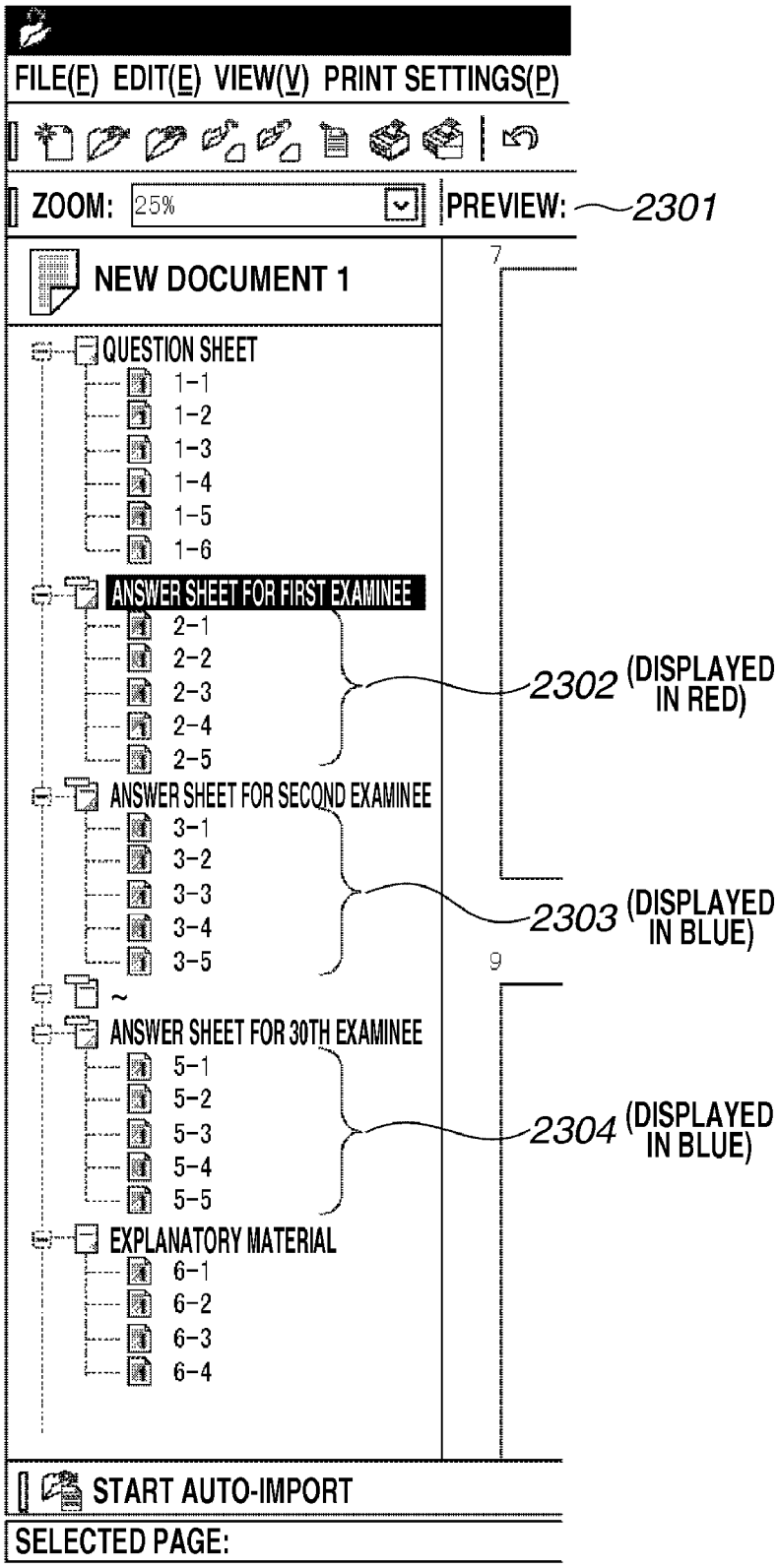
FIG. 23 illustrates a display example 2 of a tree view according to an exemplary embodiment of the present invention.

FIGS. 22 and 23 each illustrate an example of the display of the tree view according to the present exemplary embodiment.

Referring to FIG. 22, a tree view screen 2201 displays the range of each partial staple set by using brackets 2202 through 2204. Thus, the user can easily understand that the partial staple sets distinguished by the brackets 2202 through 2204 are different from one another.

Referring to FIG. 23, a tree view screen 2301 displays the range of each partial staple set by using brackets 2302 through 2304 having mutually different colors. In the example illustrated in FIG. 23, the colors of the brackets 2302 through 2304 each correspond to the color of the corresponding staple mark displayed on the above-described finishing preview screen. Thus, the correspondence between the tree view screen and the above-described finishing preview screen can be explicitly presented.

Figure 24:
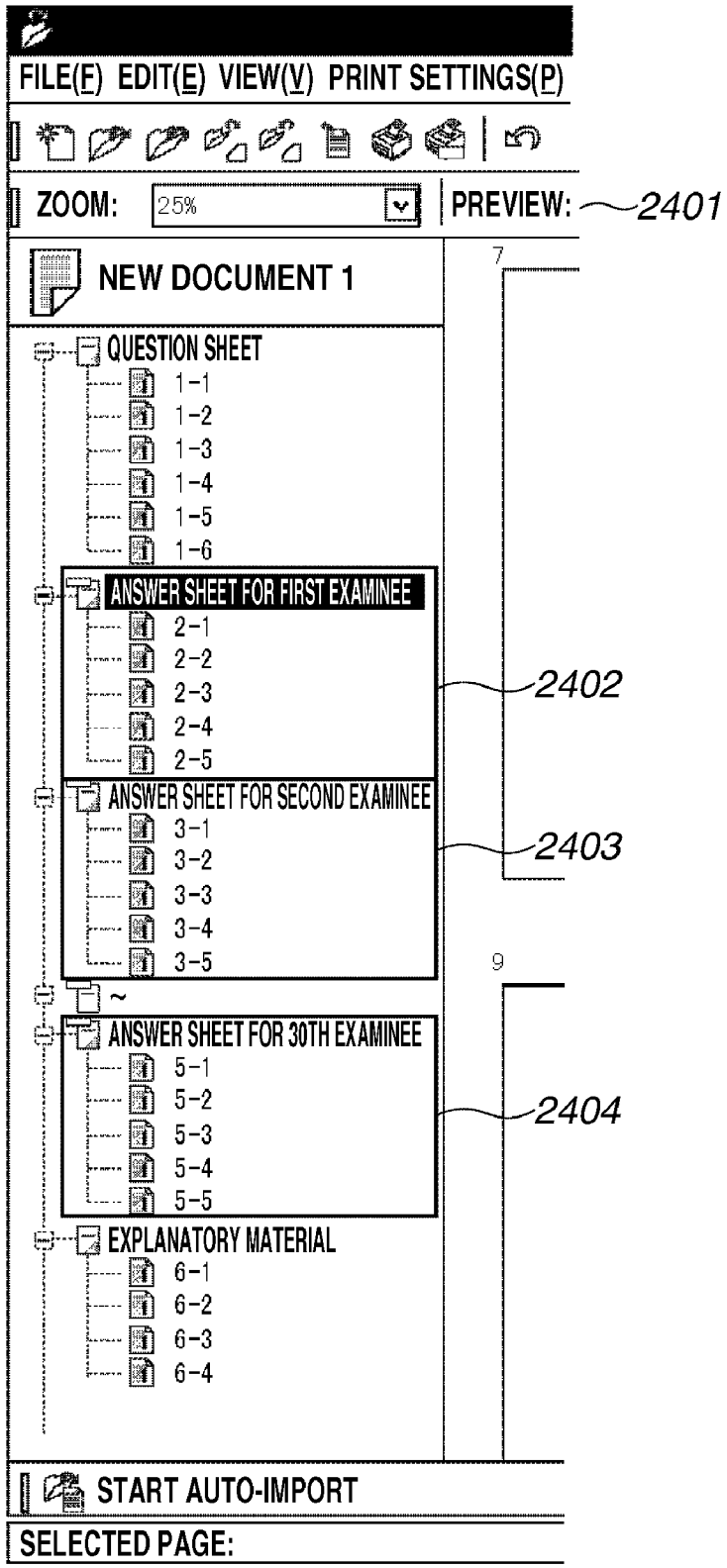
FIG. 24 illustrates a display example 3 of a tree view according to an exemplary embodiment of the present invention.
Figure 25:
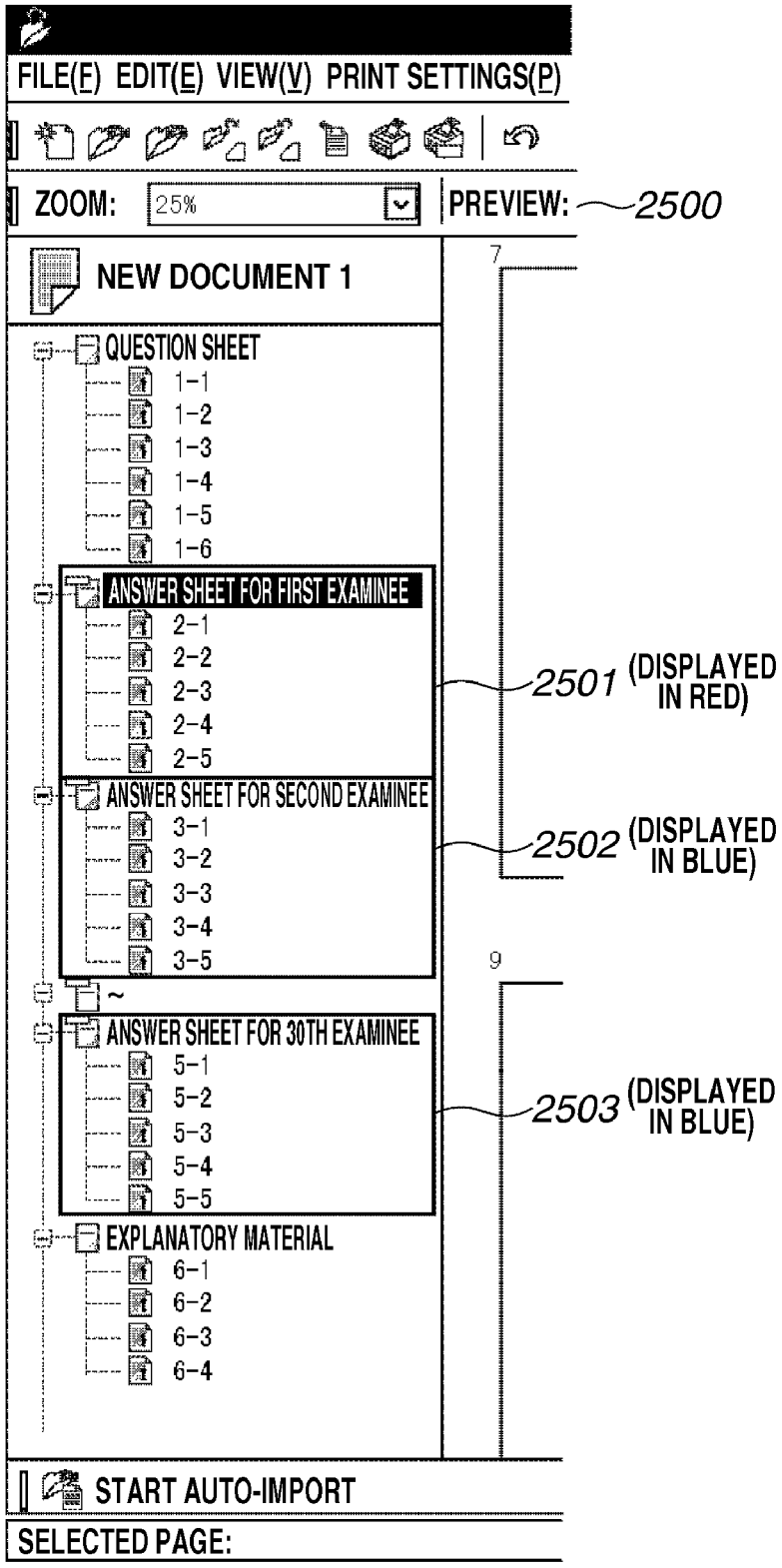
FIG. 25 illustrates a display example 4 of a tree view according to an exemplary embodiment of the present invention.

FIG. 24 illustrates an example of a tree view screen 2401 according to the present exemplary embodiment. FIG. 25 illustrates an example of a tree view screen 2500 according to the present exemplary embodiment.

As illustrated in FIGS. 24 and 25, it is also useful if the ranges of the partial staple sets are distinguished and displayed by using rectangular marks 2402 through 2404 (FIG. 24) and 2501 through 2503 (FIG. 25) as enclosing marks to explicitly display the ranges of the partial staple sets.

The CPU 201 controls the above-described brackets and enclosing marks. More specifically, the CPU 201 refers to the stapling state table 1801 to acquire the range of one partial staple set including the pages from a page whose shape of the corresponding staple is "first" through a page whose shape of the corresponding staple is "last".

Figure 26:
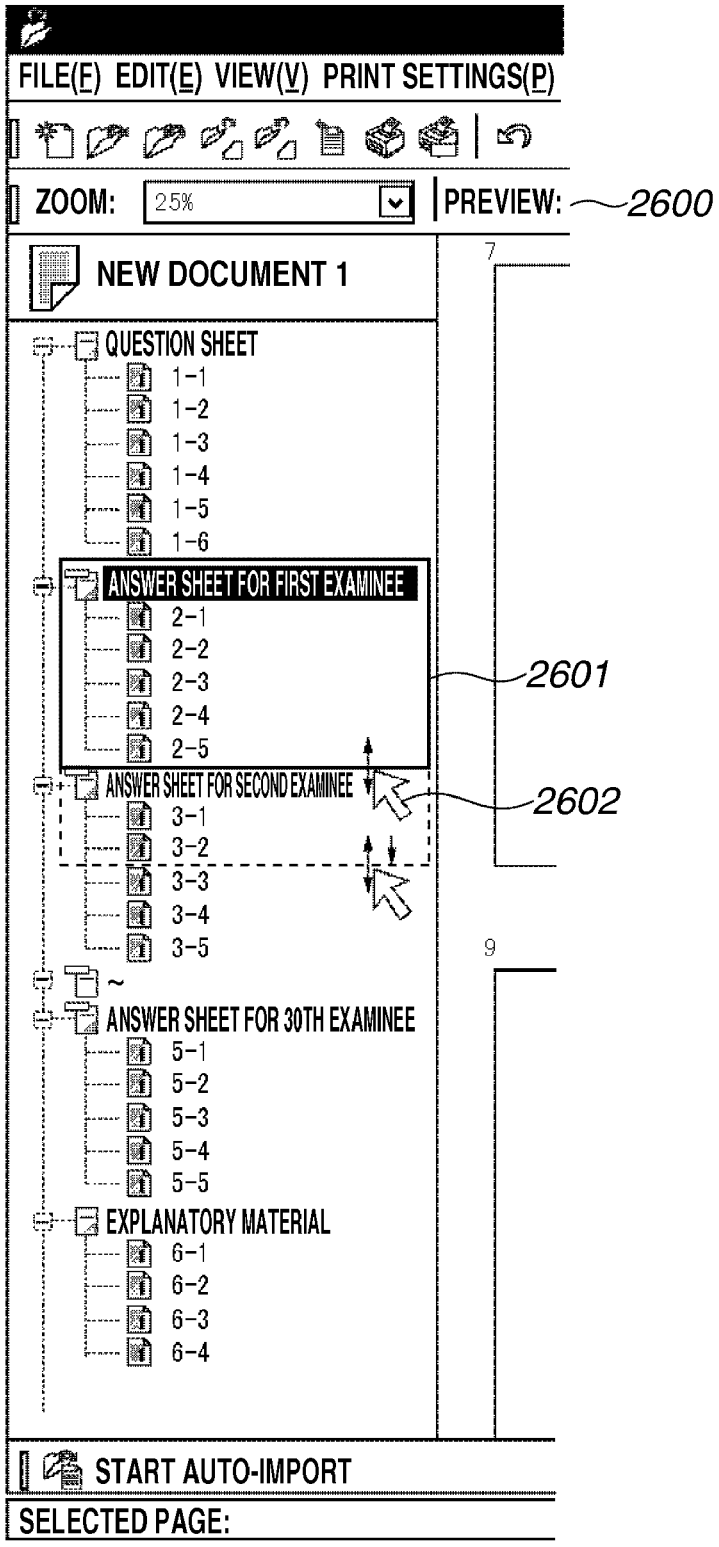
FIG. 26 illustrates an example of a state of enlarging and reducing an enclosing mark by dragging according to an exemplary embodiment of the present invention.

FIG. 26 illustrates an example of a tree view screen 2600 according to the present exemplary embodiment. In the example illustrated in FIG. 26, the user can drag a top side or a bottom side of a rectangular mark 2601, which corresponds to and indicates the partial staple set, with a mouse pointer 2602. Thus, the user can change the range of the partial staple set. In the example illustrated in FIG. 26, the tree view screen 2600 displays the pages in ascending numeric order of the page numbers from top to bottom as a tree view.

Figure 27:
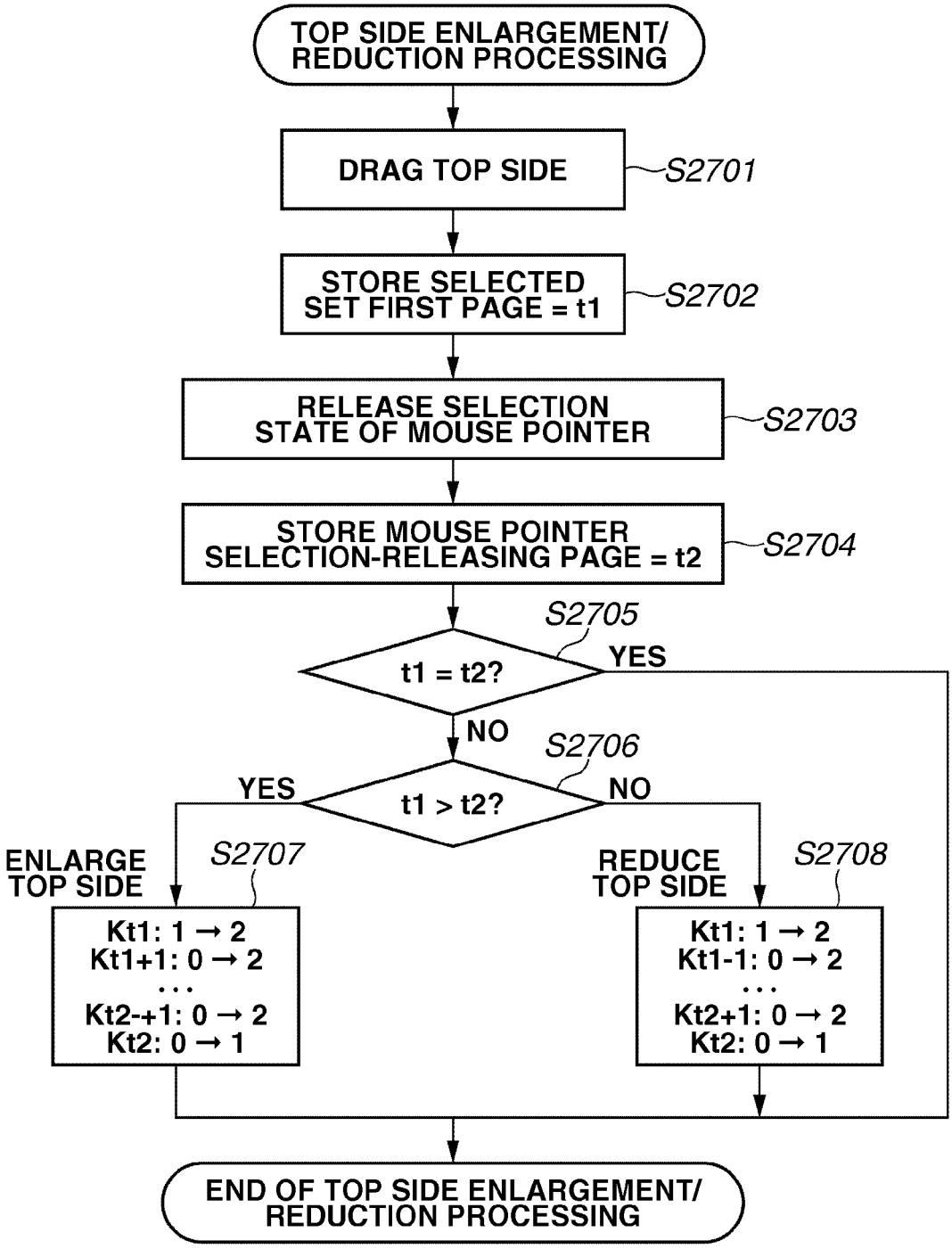
FIG. 27 is a flow chart illustrating exemplary processing for changing the shape of a staple by dragging a rectangular mark by a top side thereof according to an exemplary embodiment of the present invention.

FIG. 27 is a flow chart illustrating exemplary processing for changing the shape of a staple by vertically dragging the rectangular mark 2601 by a top side thereof according to the present exemplary embodiment.

Referring to FIG. 27 (top side enlargement/reduction processing), in step S2701, the CPU 201 detects that the user has designated the top side of the rectangular mark 2601 by operating the mouse (mouse pointer) 2602 (e.g., drag top side).

In step S2702, the CPU 201 sets a parameter "t1" for the first page of the partial staple set that has been designated by the user using the mouse pointer 2602. In addition, the CPU 201 stores the parameter "t1" on the RAM 202. The parameter "t1" has a parameter value corresponding to the page number of the page.

In step S2703 (i.e., release selection state of mouse pointer), the CPU 201 detects that the dragging of the mouse pointer 2602 has been discontinued after the designation and dragging thereof in steps S2701 and 2702.

In step S2704 (i.e., store mouse pointer selection-releasing page=t2), the CPU 201 sets a parameter "t2" for the page that is designated at the time of the discontinuation of the dragging of the mouse pointer 2602. In addition, the CPU 201 stores the parameter "t2" on the RAM 202. Similar to the parameter "t1", the parameter "t2" has a parameter value corresponding to the page number of the page.

In step S2705, the CPU 201 determines whether the values of the parameters t1 and t2 are the same. If it is determined that the values of the parameters t1 and t2 are the same (YES in step S2705), then the CPU 201 determines that the rectangular mark 2601 has not been enlarged or reduced by the user. In this case, the processing ends.

On the other hand, if it is determined that the values of the parameters t1 and t2 are different from each other (NO in step S2705), then the processing advances to step S2706.

In step S2706, the CPU 201 determines which of the values of the parameters t1 and t2 is greater. If it is determined that t1>t2 (YES in step S2706), i.e., if it is determined that the range of the rectangular mark 2601 has been enlarged upward by the user, then the processing advances to step S2707.

On the other hand, if it is determined that t1<t2 (NO in step S2706), i.e., if it is determined that the range of the rectangular mark 2601 has been reduced downward by the user, then the processing advances to step S2708.

In step S2707, the CPU 201 changes the value of the parameter K, which indicates the shape of the staple of the page t1, from "1" (="first") to "2" (="middle"). Furthermore, the CPU 201 changes the value of the parameter K, which indicates the shape of the staple of each of the pages including a page immediately previous to the page t1 (a (t1−1)-th page) through a page immediately subsequent to the page t2 (a (t2+1)-th page), from "0" (="none") to "1" (="first").

In step S2708, the CPU 201 changes the value of the parameter K, which indicates the shape of the staple of the page t1, from "1" (="first") to "0" (="none"). In addition, the CPU 201 changes the value of the parameter K, which indicates the shape of the staple of each of the pages including a page immediately subsequent to the page t1 (a (t1+1)-th page) to a page immediately previous to the page t2 (a (t2−1)-th page), from "2" (="middle") to "0" (="none").

Furthermore, the CPU 201 changes the value of the parameter K, which indicates the shape of the staple of the page t2, from "2" (="middle") to "1" (="first").

The entire processing in steps S2707 and S2708 is executed by the CPU 201. In the processing in steps S2707 and S2708, the CPU 201 acquires the value of the parameter K from the stapling state table 1801 and changes the same therein.

By executing the control described above, the CPU 201 designates and sets binding processing (stapling processing) on the partial staple set that has not been enclosed by the bracket or the enclosing mark before changing the range of the same (the rectangular mark 2601) and that is enclosed by the rectangular mark 2601 after the change of the range thereof.

In addition, by executing the control described above, the CPU 201 can disable the designation of the binding processing on the partial staple set that has been enclosed by the rectangular mark 2601 but is not enclosed thereby after the change of the range of the partial staple set.

As described above, the present exemplary embodiment changes the parameter value stored in the stapling state table 1801 if the rectangular mark (the bracket or the enclosing mark) 2601 is enlarged or reduced by the user by dragging by the top side of the rectangular mark 2601. Accordingly, the user can intuitively and easily change the range of the partial staple set.

Figure 28:
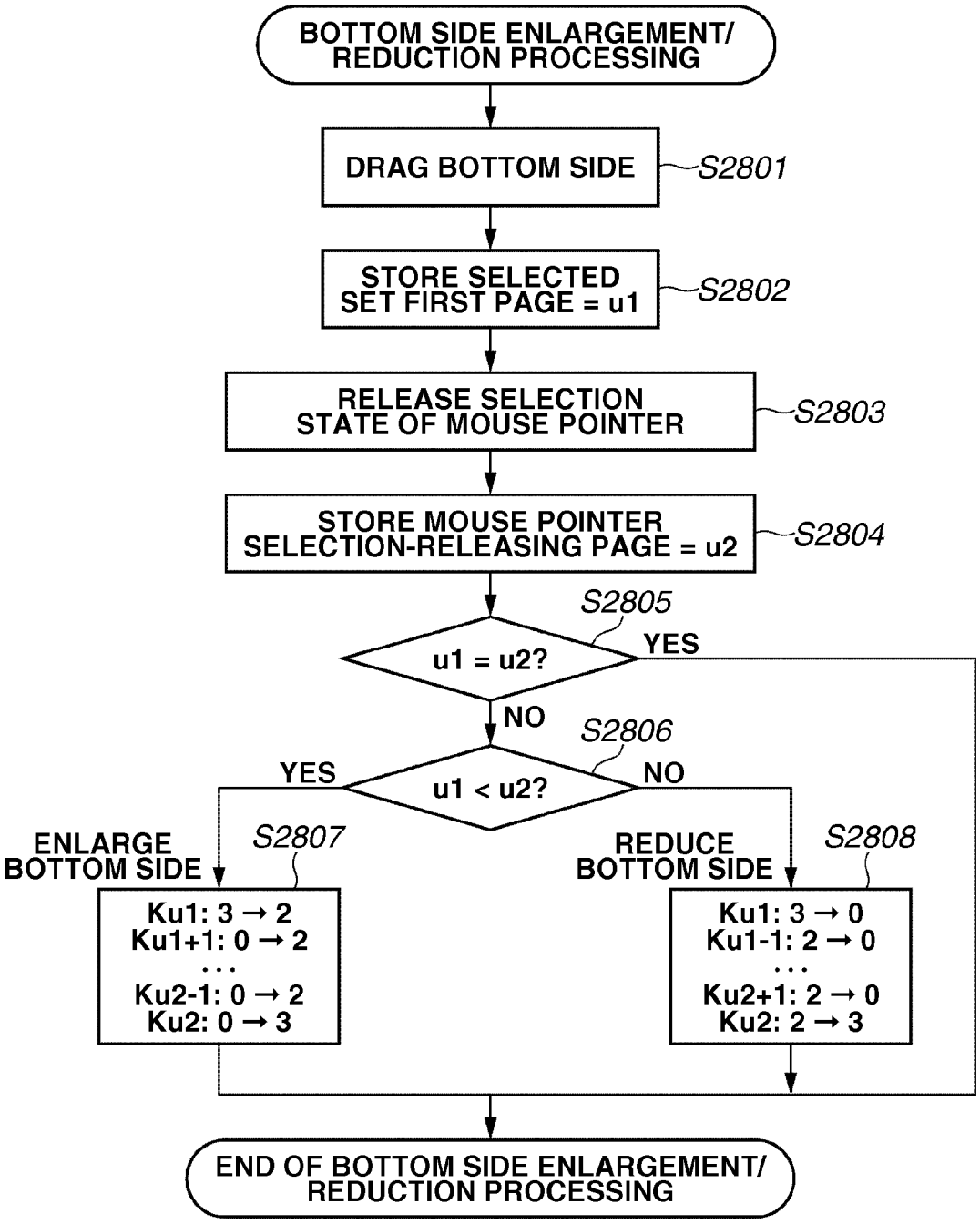
FIG. 28 is a flow chart illustrating exemplary processing for changing the shape of a staple by dragging a rectangular mark by a bottom side thereof according to an exemplary embodiment of the present invention.

FIG. 28 is a flow chart illustrating exemplary processing for changing the shape of a staple by vertically dragging the rectangular mark 2601 by the bottom side thereof according to the present exemplary embodiment.

Referring to FIG. 28 (bottom side enlargement reduction processing), in step S2801 (i.e., drag bottom side), the CPU 201 detects that the user has designated the bottom side of the rectangular mark 2601 by operating the mouse (mouse pointer) 2602.

In step S2802, the CPU 201 sets a parameter "u1" for the last page of the partial staple set that has been designated by the user by using the mouse pointer 2602. In addition, the CPU 201 stores the parameter "u1" on the RAM 202. The parameter "u1" has a parameter value corresponding to the page number of the page.

In step S2803 (i.e., release selection state of mouse pointer), the CPU 201 detects that the dragging of the mouse pointer 2602 has been discontinued after the designation and dragging thereof in steps S2801 and 2802.

In step S2804, the CPU 201 sets a parameter "u2" for the page that is designated at the time of the discontinuation of the dragging of the mouse pointer 2602. In addition, the CPU 201 stores the parameter "u2" on the RAM 202. Similar to the parameter "u1", the parameter "u2" has a parameter value corresponding to the page number of the page.

In step S2805, the CPU 201 determines whether the values of the parameters u1 and u2 are the same. If it is determined that the values of the parameters u1 and u2 are the same (YES in step S2805), then the CPU 201 determines that the rectangular mark 2601 has not been enlarged or reduced by the user. In this case, the processing ends.

On the other hand, if it is determined that the values of the parameters u1 and u2 are different from each other (NO in step S2805), then the processing advances to step S2806.

In step S2806, the CPU 201 determines which of the values of the parameters u1 and u2 is greater. If it is determined that u1<u2 (YES in step S2806), i.e., if it is determined that the range of the rectangular mark 2601 has been enlarged downward by the user, then the processing advances to step S2807.

On the other hand, if it is determined that u1>u2 (NO in step S2806), i.e., if it is determined that the range of the rectangular mark 2601 has been reduced upward by the user, then the processing advances to step S2808.

In step S2807, the CPU 201 changes the value of the parameter K, which indicates the shape of the staple of the page u1, from "3" (="last") to "2" (="middle"). Furthermore, the CPU 201 changes the value of the parameter K, which indicates the shape of the staple of each of the pages including a page immediately subsequent to the page u1 (a (u1+1)-th page) through a page immediately previous to the page u2 (a (u2−1)-th page), from "0" (="none") to "2" (="middle").

Furthermore, the CPU 201 changes the value of the parameter K, which indicates the shape of the staple of the page u2, from "0" (="none") to "3" (="last").

In step S2808, the CPU 201 changes the value of the parameter K, which indicates the shape of the staple of the page u1, from "3" (="last") to "0" (="none"). In addition, the CPU 201 changes the value of the parameter K, which indicates the shape of the staple of each of the pages including a page immediately previous to the page u1 (a (u1−1)-th page) to a page immediately subsequent to the page u2 (a (u2+1)-th page), from "2" (="middle") to "0" (="none").

Furthermore, the CPU 201 changes the value of the parameter K, which indicates the shape of the staple of the page u2, from "2" (="middle") to "3" (="last").

The entire processing in steps S2807 and S2808 is executed by the CPU 201. In the processing in steps S2707 and S2708, the CPU 201 acquires the value of the parameter K from the stapling state table 1801 and changes the same therein.

By executing the control described above, the CPU 201 designates and sets binding processing (stapling processing) on the partial staple set that has not been enclosed by the bracket or the enclosing mark before changing the range of the same (the rectangular mark 2601) and that is enclosed by the rectangular mark 2601 after the change of the range thereof.

In addition, by executing the control described above, the CPU 201 can disable the designation of the binding processing on the partial staple set that has been enclosed by the rectangular mark 2601 but is not enclosed thereby after the change of the range of the partial staple set.

As described above, the present exemplary embodiment changes the parameter value stored in the stapling state table 1801 if the rectangular mark (the bracket or the enclosing mark) 2601 is enlarged or reduced by the user by dragging by the bottom side of the rectangular mark 2601. Accordingly, the user can intuitively and easily change the range of the partial staple set.

The processing for changing the range of the partial staple set described above is not limited to the case where the rectangular mark 2601 is used. More specifically, the above-described processing can be executed if a bracket or an enclosing mark different from the rectangular mark 2601 is used.

If the range of the enclosing mark is enlarged, the range of the enlarged enclosing mark may be superposed on the range of another partial staple set.

In this case, it is also useful if the following processing is executed. More specifically, in this case, the user can merge the partial staple set whose range has been enlarged with the partial staple set that is superposed by the range-enlarged partial staple set to form one partial staple set.

Alternatively, it is also useful if the enlargement of the range of the enclosing mark is previously restricted so that the enclosing mark for a partial staple set may not be superposed with that of another partial staple set.

Figure 29:
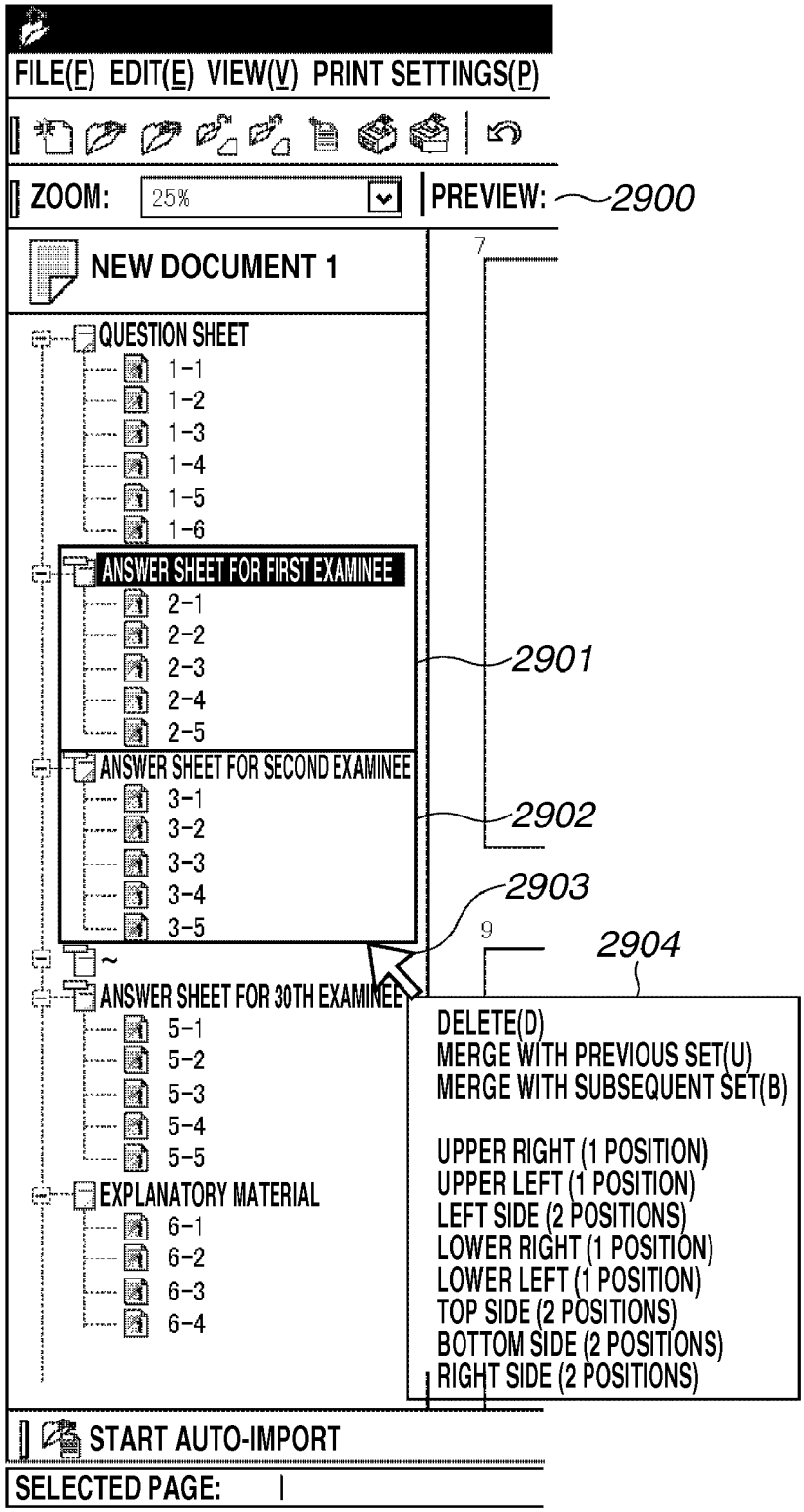
FIG. 29 illustrates an example of a right-click menu screen displayed on a tree view screen according to an exemplary embodiment of the present invention.

FIG. 29 illustrates an example of a right-click menu screen displayed on a tree view screen 2900 according to the present exemplary embodiment.

In the example illustrated in FIG. 29, a right-click menu 2904 is displayed when the user right-clicks on the tree view screen 2900 with a mouse pointer 2903. Thus, the user can disable the designation of the staples, merge a partial staple set with another partial staple set existing immediately previous or subsequent thereto, and change the type of the staple.

Figure 30:
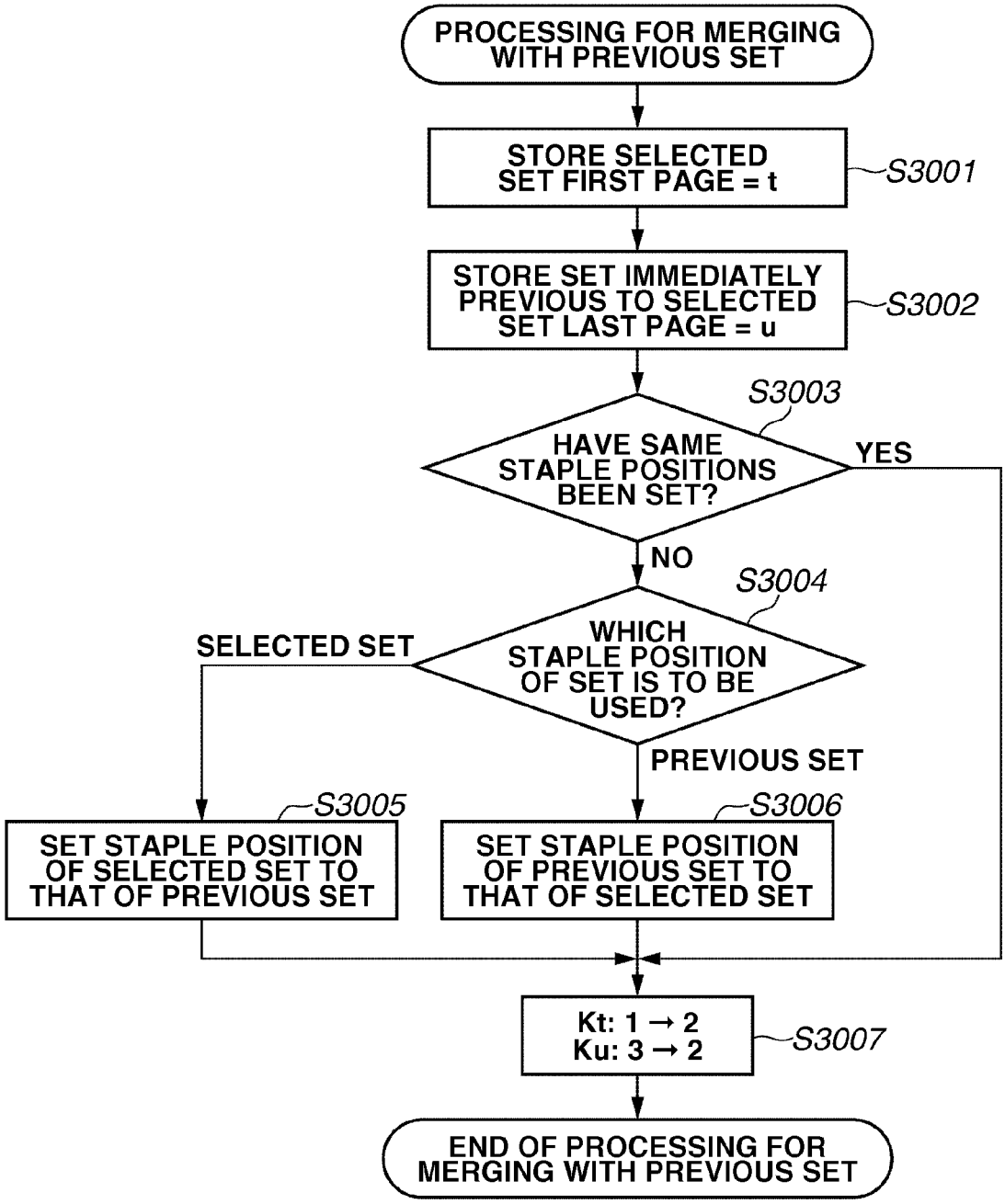
FIG. 30 is a flow chart illustrating exemplary processing for changing the shape of a staple in merging a set with a previous set according to an exemplary embodiment of the present invention.

FIG. 30 is a flow chart illustrating exemplary processing executed by the CPU 201 when the user designates "merge with previous set" by using the mouse pointer 2903 in the document processing system according to the present exemplary embodiment.

Referring to FIG. 30, in step S3001, the CPU 201 sets a parameter "t" as the page number of the first page of the partial staple set enclosed by a rectangular mark 2902, which has been designated by the user by using the mouse pointer 2903 (the above-described partial staple set is hereafter referred to as a "partial staple set 2902"). In addition, the CPU 201 stores the parameter t on the RAM 202.

In step S3002, the CPU 201 sets a parameter "u" as the page number of the last page of a partial staple set displayed immediately previous to the partial staple set enclosed by the rectangular mark 2902 (the above-described immediately previous partial staple set, i.e., a plurality of pages enclosed by a rectangular mark 2901, is hereafter referred to as a "partial staple set 2901"). In addition, the CPU 201 stores the parameter u on the RAM 202.

In step S3003, the CPU 201 refers to the stapling state table 1801 to acquire the staple position that have been designated by the user for each of the partial staple set 2902 and the partial staple set 2901.

Furthermore, the CPU 201 determines whether the staple positions are the same. If it is determined that the staple positions are the same (YES in step S3003), then the processing advances to step S3007.

On the other hand, if it is determined that the staple positions are different from each other (NO in step S3003), then the processing advances to step S3004.

In step S3004, the CPU 201 displays a message that prompts the user to determine which of the staple position designated for the partial staple set 2901 and that designated for the partial staple set 2902 is to be applied.

If the user issues an instruction for applying the staple position designated for the partial staple set (hereinafter simply referred to as a "selected set") 2902 in response to the inquiry to the user displayed as described above that prompts the user to select the staple position, then the processing advances to step S3005.

On the other hand, if the user issues an instruction for applying the staple position designated for the partial staple set (hereinafter simply referred to as a "previous set") 2901 in response to the inquiry described above, then the processing advances to step S3006.

In step S3005, the CPU 201 applies the staple position designated for the partial staple set 2902 as the staple position for the partial staple set 2901.

In step S3006, the CPU 201 applies the staple position that has been set to the partial stapling set 2901 as that for the partial stapling set 2902.

In "applying" the staple position in steps S3005 and 3006, the CPU 201 acquires the staple position information set for each partial staple set from the RAM 202 and writes the acquired staple position information in the stapling state table 1801.

In step S3007, the CPU 201 changes the value of the parameter K, which indicates the shape of the staple for the page t, from "1" (="first") to "2" (="middle"). In addition, the CPU 201 changes the value of the parameter K, which indicates the shape of the staple for the page u, from "3" (="last") to "2" (="middle"). The CPU 201 changes the parameter values on the stapling state table 1801.

Figure 31:
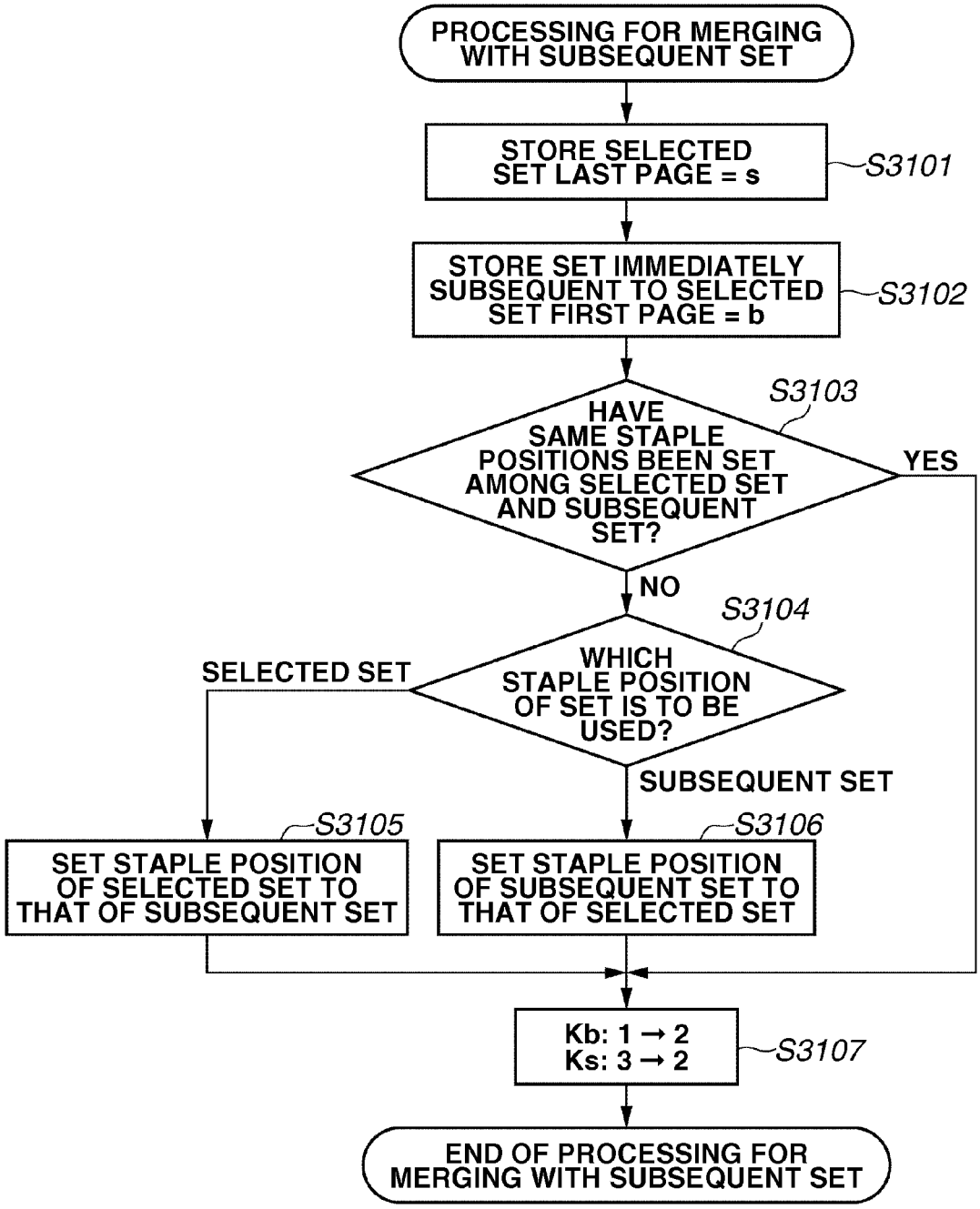
FIG. 31 is a flow chart illustrating exemplary processing for changing the shape of a staple in merging a set with a subsequent set according to an exemplary embodiment of the present invention.

FIG. 31 is a flow chart illustrating exemplary processing executed if the user designates "merge with subsequent set" by using the partial staple set 2903 in the document processing system according to the present exemplary embodiment.

Referring to FIG. 31, in step S3101, the CPU 201 sets a parameter "s" as the page number of the last page of the partial staple set 2902, which has been designated by the user by using the mouse pointer 2903. In addition, the CPU 201 stores the parameter s on the RAM 202.

In step S3102, the CPU 201 sets a parameter "b" as the page number of the first page of a partial staple set displayed immediately subsequent to the partial staple set 2902 (the above-described immediately subsequent partial staple set (not illustrated) is hereafter referred to as a "subsequent partial staple set"). In addition, the CPU 201 stores the parameter b on the RAM 202.

In step S3103, the CPU 201 refers to the stapling state table 1801 to acquire the staple position that has been designated by the user for each of the partial staple set 2902 and the subsequent partial staple set.

Furthermore, the CPU 201 determines whether the staple positions are the same. If it is determined that the staple positions are the same (YES in step S3103), then the processing advances to step S3107.

On the other hand, if it is determined that the staple positions are different from each other (NO in step S3103), then the processing advances to step S3104.

In step S3104, the CPU 201 displays a message that prompts the user to determine which of the staple position designated for the subsequent partial staple set and that designated for the partial staple set 2902 is to be applied.

If the user issues an instruction for applying the staple position designated for the partial staple set (the "selected set") 2902 in response to the inquiry to the user displayed as described above that prompts the user to select the staple position, then the processing advances to step S3105.

On the other hand, if the user issues an instruction for applying the staple position designated for the subsequent partial staple set (the "subsequent set") in response to the inquiry described above, then the processing advances to step S3106.

In step S3105, the CPU 201 applies the staple position designated for the partial staple set 2902 as the staple position for the subsequent partial staple set.

In step S3106, the CPU 201 applies the staple position that has been set to the subsequent partial staple set as that for the partial stapling set 2902.

In "applying" the staple position in steps S3105 and 3006, the CPU 201 acquires the staple position information set for each partial staple set from the RAM 202 and writes the acquired staple position information in the stapling state table 1801.

In step S3107, the CPU 201 changes the value of the parameter K, which indicates the shape of the staple for the page b, from "1" (="first") to "2" (="middle"). In addition, the CPU 201 changes the value of the parameter K, which indicates the shape of the staple for the page s, from "3" (="last") to "2" (="middle"). The CPU 201 changes the parameter values on the stapling state table 1801.

Figure 32:
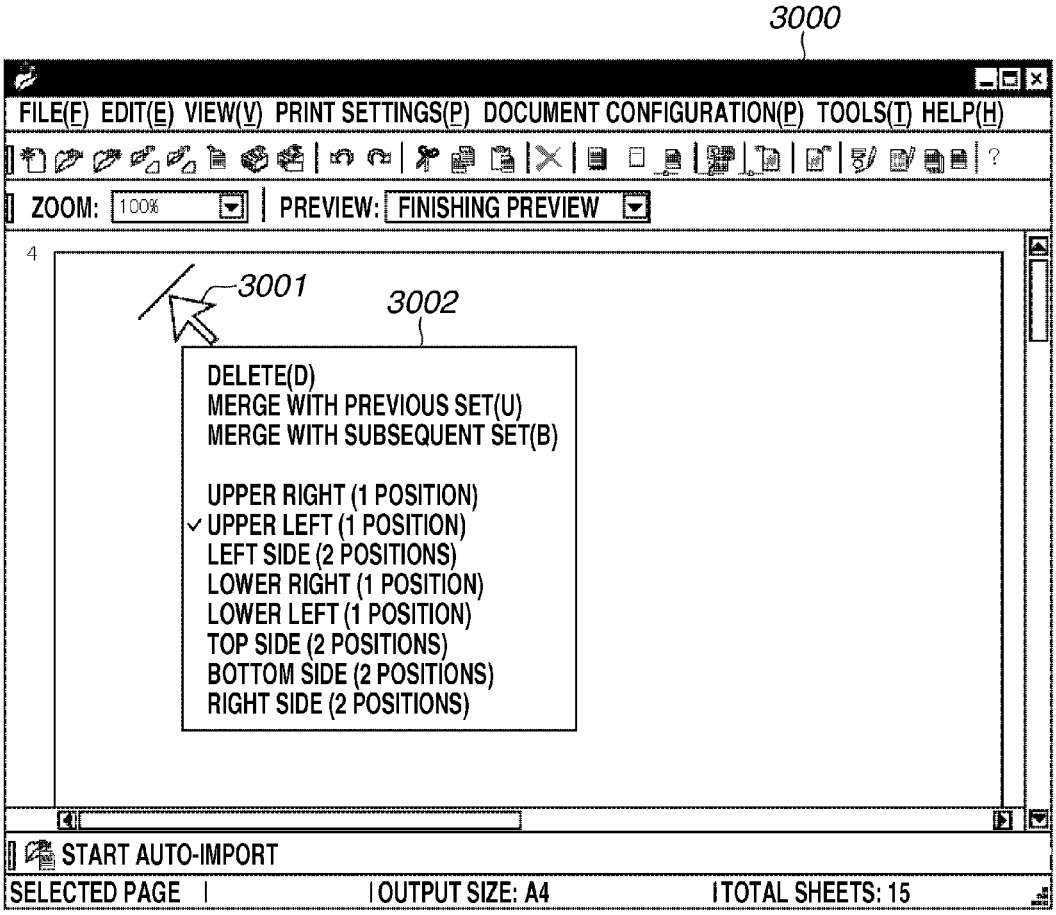
FIG. 32 illustrates an example of a right-click menu screen displayed on a preview screen according to an exemplary embodiment of the present invention.

The above-described exemplary processing illustrated in FIGS. 29 through 31 can be executed according to the staple mark displayed on the finishing preview screen as illustrated in FIG. 32.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-269563 filed Oct. 20, 2008, which is hereby incorporated by reference herein in its entirety.

What is claimed is:

1. An apparatus comprising:

a setting unit configured to set binding processing for binding a part of document data including data of a plurality of pages as a partial binding set for the document data; and a display control unit configured to display a setting verification image for verifying a status of setting of the binding processing by using a binding mark, which indicates that the binding processing is set, on a display apparatus in which the plurality of partial binding sets are discriminable.

2. The apparatus according to claim 1, wherein the display control unit is configured to display the binding mark displayed on the plurality of partial binding sets in at least two different colors.

3. The apparatus according to claim 1, wherein the display control unit is configured to use at least two mutually different colors as the colors of the binding marks, of the plurality of partial binding sets, which are displayed on partial binding sets existing adjacent to one another that do not include therebetween the page data to which the binding processing has not been set.

4. The apparatus according to claim 1, wherein the setting verification image includes a preview image, which is a predicted output of the data of the plurality of pages.

5. The apparatus according to claim 1, wherein the display control unit is configured to display a first binding mark on a first page of each of the partial binding sets and a second binding mark on a last page of each of the partial binding sets.

6. The apparatus according to claim 5, wherein the display control unit is configured to display a third binding mark on a page between the first page and the last page of the partial binding set.

7. The apparatus according to claim 1, wherein the display control unit is configured to display a tree view of the data of the plurality of pages as the setting verification image.

8. The apparatus according to claim 7, wherein the display control unit is configured to display an enclosing mark on each partial binding set in the tree view.

9. The apparatus according to claim 8, further comprising a changing unit configured to change a range to be enclosed with the enclosing mark according to an instruction from a user, wherein the setting unit is configured to change the setting for the binding processing according to the changed range.

10. The apparatus according to claim 9, wherein the setting unit is configured to set the binding processing on a partial binding set of the document data that is not enclosed with the enclosing mark before the enclosing mark is changed and is enclosed with the enclosing mark after the change thereof and configured to disable the binding processing that is set for the partial binding set that is enclosed with the enclosing mark before the enclosing mark is changed but is not enclosed with the enclosing mark after the enclosing mark is changed.

11. The apparatus according to claim 8, wherein the enclosing mark is one of a bracket and a rectangular mark.

12. The apparatus according to claim 1, wherein the binding processing includes stapling processing.

13. An apparatus comprising:

a first setting unit configured to set first binding processing for binding a part of the document data including data of a plurality of pages as a partial binding set for the document data; and a second setting unit configured to set second binding processing so that a partial binding set to which the first binding processing is set and a part of the document data, which exists subsequent to the partial binding set, are to be bound as one integrated set.

14. A method comprising:

setting binding processing for binding a part of the document data including data of a plurality of pages as a partial binding set for the document data; and displaying a setting verification image for verifying a status of setting of the binding processing by using a binding mark, which indicates that the binding processing is set, on a display apparatus in a display state in which the plurality of partial binding sets are discriminable.

15. The method according to claim 14, further comprising displaying the binding mark displayed on the plurality of partial binding sets in at least two different colors.

16. The method according to claim 14, further comprising using at least two mutually different colors as the colors of the binding marks, of the plurality of partial binding sets, which are displayed on partial binding sets existing adjacent to one another that do not include therebetween the page data to which the binding processing has not been set.

17. The method according to claim 14, wherein the setting verification image includes a preview image, which is a predicted output of the data of the plurality of pages.

18. The method according to claim 14, further comprising displaying a first binding mark on a first page of each of the partial binding sets and a second binding mark on a last page of each of the partial binding sets.

19. The method according to claim 18, further comprising displaying a third binding mark on a page between the first page and the last page of the partial binding set.

20. The method according to claim 14, further comprising displaying a tree view of the data of the plurality of pages as the setting verification image.

21. The method according to claim 20, further comprising displaying an enclosing mark on each partial binding set in the tree view.

22. The method according to claim 21, further comprising:

changing a range to be enclosed with the enclosing mark according to an instruction from a user; and changing the setting for the binding processing according to the changed range.

23. The method according to claim 22, further comprising:

setting the binding processing on a partial binding set of the document data that is not enclosed with the enclosing mark before the enclosing mark is changed and is enclosed with the enclosing mark after the change thereof; and disabling the binding processing that is set for the partial binding set that is enclosed with the enclosing mark before the enclosing mark is changed but is not enclosed with the enclosing mark after the enclosing mark is changed.

24. The method according to claim 21, wherein the enclosing mark is one of a bracket and a rectangular mark.

25. The method according to claim 14, wherein the binding processing includes stapling processing.

26. A method comprising:

setting first binding processing for binding a part of the document data including data of a plurality of pages as a partial binding set for the document data; and setting second binding processing so that a partial binding set to which the first binding processing is set and a part of the document data, which exists subsequent to the partial binding set, are to be bound as one integrated set.

27. A computer-readable storage medium storing instructions which, when executed by a computer, cause the computer to perform the control method according to claim 14.

28. A computer-readable storage medium storing instructions which, when executed by a computer, cause the computer to perform the control method according to claim 26.

29. The apparatus according to claim 6, wherein the first, second, and third binding marks are different marks.

30. The method according to claim 19, wherein the first, second, and third binding marks are different marks.

* * * * *